US007344122B2

(12) United States Patent
Gasaway et al.

(10) Patent No.: US 7,344,122 B2
(45) Date of Patent: Mar. 18, 2008

(54) JOINT CONNECTION AND APPLICATIONS

(76) Inventors: Mark S. Gasaway, 1610 Yale St., Houston, TX (US) 77008; Marvin Kent Gasaway, 1003 Timothy, East Bernard, TX (US) 77435

( * ) Notice: Subject to any disclaimer, the term of this patent is extended or adjusted under 35 U.S.C. 154(b) by 0 days.

(21) Appl. No.: 10/790,532

(22) Filed: Mar. 1, 2004

(65) Prior Publication Data

US 2005/0189532 A1 Sep. 1, 2005

(51) Int. Cl.
*E04H 17/00* (2006.01)

(52) U.S. Cl. ..... 256/65.11; 256/65.01; 256/65.02

(58) Field of Classification Search ..... 256/1, 256/21, 59, 65.01, 65.02, 65.09, 65.11; 52/655.1, 52/736; 403/274, 276, 279, 281, 282, 263, 403/242
See application file for complete search history.

(56) References Cited

U.S. PATENT DOCUMENTS

| | | | | | |
|---|---|---|---|---|---|
| 823,451 | A * | 6/1906 | Sweeney et al. | 403/186 |
| 917,083 | A * | 4/1909 | Kyle | 256/52 |
| 1,320,982 | A * | 11/1919 | Boyle | 403/263 |
| 1,473,817 | A * | 11/1923 | Gorsline | 108/157.17 |
| 1,808,082 | A * | 6/1931 | Thompson | 52/637 |
| 2,113,403 | A * | 4/1938 | Harmon | 280/796 |
| 2,640,567 | A * | 6/1953 | Pressnall | 403/231 |
| 2,710,053 | A * | 6/1955 | Hamilton | 297/440.24 |
| 2,996,790 | A | 8/1961 | Trafford | |
| 3,021,116 | A * | 2/1962 | Querengesser | 256/72 |
| 3,232,378 | A * | 2/1966 | Larson | 182/194 |
| 3,286,416 | A | 11/1966 | Ashworth | |
| 3,410,349 | A | 11/1968 | Troutman | |
| 4,137,576 | A * | 2/1979 | Greene | 52/73 |
| 4,189,250 | A * | 2/1980 | Abbott et al. | 403/190 |
| 4,193,584 | A | 3/1980 | Wieser | |
| 4,390,103 | A * | 6/1983 | Husband | 211/182 |
| 4,509,617 | A | 4/1985 | Lapeyre | |
| 4,682,762 | A | 7/1987 | Lekavich | |
| 4,926,759 | A * | 5/1990 | Vitsky et al. | 108/180 |
| 5,120,025 | A * | 6/1992 | D'Avanzo | 256/22 |
| 5,149,060 | A | 9/1992 | Boes | |
| 5,177,926 | A | 1/1993 | Frankel | |
| 5,230,597 | A | 7/1993 | Nuttall | |
| 5,277,408 | A | 1/1994 | Parker | |
| 5,330,066 | A * | 7/1994 | Carroll | 211/189 |
| 5,350,155 | A | 9/1994 | Burk | |
| 5,496,016 | A * | 3/1996 | Parisien | 256/68 |
| 5,520,475 | A | 5/1996 | Coolman et al. | |
| 5,803,438 | A * | 9/1998 | Blouin | 256/66 |
| 5,882,001 | A | 3/1999 | Reinbold | |
| 6,131,286 | A | 10/2000 | Kelly et al. | |
| 6,131,888 | A | 10/2000 | Brown | |
| 6,199,336 | B1 * | 3/2001 | Poliquin | 52/489.1 |
| 6,640,567 | B2 | 3/2002 | Kim et al. | |
| 6,406,003 | B1 * | 6/2002 | Shaw | 256/36 |
| 6,643,988 | B1 * | 11/2003 | Armstrong et al. | 52/656.2 |
| 6,682,055 | B1 * | 1/2004 | Tomlinson et al. | 256/1 |

* cited by examiner

*Primary Examiner*—Gregory J. Binda
*Assistant Examiner*—Daniel J. Mills
(74) *Attorney, Agent, or Firm*—Fulbright & Jaworski, LLP

(57) ABSTRACT

A fence brace assembly, and method for assembling a fence brace assembly comprising at least one post, at least one member, at least one joint connection comprising an opening in a stabilizing surface, at least one tab-slot in a securing surface, wherein the member has at least one tab, the member passes through the opening in the stabilizing surface, and the tabs engage the tab slots in the tab-slots in the securing surface. Also a kit for assembling a fence brace assembly having component parts capable of being assembled in the field and adapted for use with a plurality of fence posts.

19 Claims, 16 Drawing Sheets

JOINT CONNECTION AND APPLICATIONS

BACKGROUND OF THE INVENTION

The present invention generally relates to a system and method of fastening one or more pieces of material together in a wide range of applications. It is desirable to couple materials together in a manner that is both stable and secure. More specifically, the present invention allows for structures to be made of pieces that are securely coupled together without necessarily requiring welding or fasteners, although, optionally, welding and/or fasteners may also be used and/or required. The resulting structures are made of stable, sturdy and load bearing joint connections and are, for example, easy to assemble and cost-effective.

In the past, ways of fastening materials together have included welding and non-welding techniques. Non-welding fastening techniques have, for example, used all types of pins, screws, elbow, tee, crosses, standard and custom fittings, and bolts as fasteners to hold materials together. While these fasteners may hold materials together securely, they generally add to the cost of the structure. Also, fasteners can rust, become loosened, break under a heavy weight burden, and be stripped so as to no longer be amenable to tightening or loosening. Further, in many arrangements, it is not easy or effective to use fasteners due, for example, to constraints in size and materials. For example, fasteners are infeasible on many very small applications, such as those in the field of nanotechnology.

Welding is also used as a means of coupling some types of materials together. Welding, however, has many disadvantages. Welding requires a skilled technician to perform the fastening technique, because it is dangerous, requires special tools, safety equipment, and knowledge of how to carefully position materials to result in the desired final structure. Furthermore, welding presents a wild fire hazard, due to flying sparks; welding forms permanent attachments that are generally irreversible; welds may fracture, rust, or otherwise be unsuitable for bearing heavy loads; welding is not feasible for use with many types of materials, such as plastics and many composites that might be desirable building materials; welding compromises the integrity of plating or coating in or near the weld joint—e.g., at the present time, even properly done welds can cause a brittleness in the heat affected area that may not be picked up by inspections of strength, such as X-rays; and, for example, welding may not be a feasible means of fastening materials on the nanotechnology scale as of today.

Another commonly used way of fastening materials together is using a fastener such as an elbow or joint coupling piece, to couple together various materials. However, this type of fastening often requires, for example, skilled assembly and custom made fasteners. Also, fastening materials together using an elbow or separate joint piece is sometimes used for applications that are merely ornamental, and the resulting joints may have limited structural strength and load bearing capacity.

It can be seen that a connection that requires welding, joint pieces or fasteners is not always desirable or cost effective. The present invention is directed to eliminating the necessity of such types of joining, without excluding the use of those means when desirable.

It is especially desirable to couple materials together using an improved joint connection, for example, for fencing, animal pens, ornamental fencing, gates, antennas, ladders, railings, scaffolding, and other uses such as, but not limited to, metal wall studs, building structural members, oilwell downhole perforating equipment. The improved joint connection of the present invention does not necessarily require welding or fasteners, although optionally welding and/or fasteners may be used. The improved joint connection is desirable in the fastening of multi-component systems such as structural strengthening designs for support including, for example, support beams for roofing, support beams of airplane wings, tent-like structures, temporary buildings and hunting units such as deer stands and deer blinds, outdoor venue applications, and other uses such as, but not limited to ships, bridges, HVAC duct work, man ways, sewer, water and electrical conduits, vents, nanotech structures, automotive structures, bumpers, and pick-up truck accessories.

Similarly, an improved joint connection as disclosed herein is desirable for the secure construction of stair rails, catwalks, and safety railing and in machinery and equipment, as a component of a larger device or system with moving parts such as, for example, construction equipment, conveyor framework of all types, sand, gravel, and rock crushing equipment framework, cattle handling and milking equipment, animal laboratory equipment, automotive components, motorcycle, bicycle, tricycle, and unicycle components, irrigation equipment (for example, center pivots), and other uses such as, but not limited to harvesting equipment, farm equipment, mowers, and security equipment such as jail, commercial, or residential door locks and devices.

There is similarly a need for a design to connect materials together without necessarily requiring welding or fasteners, for such applications as connecting materials for strengthening structural designs such as, but not limited to, commercial fishing applications, space station or space craft applications, helix-type designs, medical and/or surgical devices, agricultural grain storage and handling, water towers, petrochemical storage tanks, highway signage structures, wildlife feeder structures, isotainer frames, light beacon towers, duct systems, among other envisioned applications, and other uses such as, but not limited to microwave towers, cell phone towers, oilfield drilling equipment, oilfield completion equipment, and oilfield servicing and testing equipment.

There is also a need for a design to connect materials together on the small scale, including in the field of nanotechnology, where the use of welding and fasteners is often infeasible. There is also a need for a design to connect dissimilar materials, such as, for example, to connect a steel tube to a plastic or wooden object.

More particularly, there is a need for a joint connection in a fence brace assembly that does not necessarily require welding or fasteners. Barbed wire fences and other animal fencing materials such as mesh and electrical fencing are commonly used on ranches and farms to contain livestock and keep out predators and trespassers. Such fences are constructed by setting posts in the ground, and attaching strands of barbed wire to each post in a line of posts. Typically, the posts used are wooden or metal, and at corners or gates in the fence, a brace is used to keep the posts upright and the wire tight along the line of the fence. It is common to use a combination of wood posts and metal posts, where the metal posts, assembled into a brace, are installed at corners or gates and at adjacent post locations. Commonly, a metal rail is welded in place between the end, corner, or gate post and the adjacent metal post, and wooden, metal or plastic posts are used for the rest of the line of fence. Barbed wire can be strung securely between the metal end, corner, or gate posts and the wooden posts along the line of the fence.

A brace assembly is an anchor point that is designed to withstand the load from the fence wires. The end and corner posts are relied upon to hold the fence tight, prevent sagging and prevent the fence from failing. Under normal conditions, the tensioned fence wires will exert a pull on the brace of 1,000 to 1,500 pounds, and under cold weather conditions, may exert a pull as high as 2,500 pounds. Additional load stress is delivered to the wires by, for example, sand and snow drifts, livestock pushing against the fence, fallen trees, motor vehicles and other such stresses. When end and corner brace assemblies are properly constructed, a few line posts can fail without affecting the whole fence, and breaks in the fencing wire can be easily repaired; compared with the failure of a brace assembly that may require that the entire fence be rebuilt. As is well-known by one skilled in the art, the brace assembly width is typically at least two times the height of the fence, and preferably two and a half times the height of the fence.

While a commonly used welded fence brace assembly may provide a satisfactory barbed wire fence, it is often inconvenient, expensive, and dangerous to weld on location in every location along the fence line where a corner or gate post is desired. Welding has all of the other disadvantages discussed above. It is desirable to build a fence brace assembly, particularly those used for in-line, line end, corner or gate posts, such that welding is merely optional. It is similarly desirable to build a fence brace assembly that may be easily and inexpensively assembled on the location by a layperson desiring a fence.

Many fence brace assemblies using wooden posts also employ an in-line strainer wire, which squeezes the wooden posts together and serves to keep the posts vertical and under tension. The no-weld joint of the present invention eliminates the need for an in-line strainer wire, which is difficult to install and requires on-going maintenance for the beneficial effect. The present invention eliminates the need for an in-line strainer wire by employing a design that stabilizes and secures the member to the posts at the desired angle.

Generally, fence brace assemblies have been sold in two ways. First, a fence brace assembly can be sold whole, already fully or partially welded together. One such a fence brace assembly is commonly known as an H-post or a V-post. However, assembled, already welded portions of fence are awkward to transport as well as install. Second, fence brace assemblies can be sold as individual pieces in a kit. When the pieces are sold separately and unassembled, building the fence brace assembly typically requires welding. There is, therefore, a need for a kit that may be sold with the pieces disassembled, that may be put together without requiring welding. Such a kit would be easy to transport and simple enough for a layperson to assemble with little or no assistance.

Hence, there is a need for a design for a joint connection that does not necessarily require welding or fasteners, yet provides a stable, load bearing connection. Furthermore, there is a need specifically for a design for a fence brace assembly with a joint connection that does not necessarily require welding or other fasteners, and can be easily assembled by a layperson building the fence.

BRIEF SUMMARY OF THE INVENTION

It is, therefore, an object of the present invention to provide an improved method of fastening materials.

It is, therefore, an object of the present invention to provide an improved method of fastening materials for fences in various applications.

It is, therefore, an additional object of the present invention to provide an improved method of fastening materials for scaffolding.

It is, therefore, an object of the present invention to provide an improved method of fastening materials without requiring welding and special expertise, although welding is not excluded. The material can be coupled together, for example, either permanently or reversibly.

An additional object of the present invention is to provide an improved method of fastening materials together in such a way that stability and load bearing capacity are provided along with coupling the materials together.

A further object of the present invention is the provision of a fastening system that provides an inexpensive method of fastening materials together.

A further object of the present invention is the provision of a fastening system that improves the stability and load-bearing capacity of fencing materials coupled without requiring welding.

Yet another object of the invention is to provide a kit that can be sold disassembled and later assembled with ease on the location where the fence or structure is needed, reducing freight and shipping expenses.

A further object of the present invention is that the fastening system and method are not limited to any particular size of application, but spans applications such as, for example, scaffolding, ladders, fencing, farm gates, isotainer frame kits, conveyor frame kits, to structures on the nano-scale.

Another object of the present invention is that the fastening system and method are not limited in the type of the materials used, and may be applied to materials ranging, for example, from plastics, metals, composites, wood, and materials used in the field of nanotechnology.

Yet another object of the present invention is that various piece of fencing material may be permanently coupled together without bolts, screws or other fasteners, simplifying assembly of kits; however, optionally, fasteners may be used.

Still another object of the present invention is to provide lower cost of kits that individuals can assemble without a welder, thus reducing wildfire hazards and other health, safety and environmental issues.

In one embodiment, the present invention is directed to a fence brace assembly comprising at least one post, at least one member, at least one joint connection comprising an opening in a stabilizing surface, at least one tab-slot in a securing surface, wherein the member has at least one tab, the member passes through the opening in the stabilizing surface, and the tabs engage the tab slots in the tab-slots in the securing surface.

In one embodiment of the fence brace assembly, the stabilizing surface and the securing surface are in a common surface. In one embodiment of the joint connection, the stabilizing surface and the securing surface are both in the outer surface of a post. In one embodiment of the joint connection, the stabilizing surface and the securing surface are not both in a common surface. The fence brace assembly of claim 1, wherein said stabilizing surface and said securing surface are both in the outer surface of said at least one post.

In one embodiment of the fence brace assembly, the fence brace assembly comprises two or more posts. In one embodiment of the fence brace assembly, the fence brace assembly comprises two or more members. In one embodiment of the fence brace assembly, the fence brace assembly additionally comprises at least one angle brace foot post; and at least one angle brace member.

In one embodiment of the fence brace assembly, the member has two tabs. In one embodiment of the fence brace assembly, the member has two or more tabs.

In one embodiment of the fence brace assembly, at least one post is comprised of painted, or powder coated, or galvanized metal tubing. In one embodiment of the fence brace assembly, at least one member is comprised of painted, or powder coated, or galvanized metal tubing. In one embodiment of the fence brace assembly, the opening corresponds in shape and size to said member. In one embodiment of the fence brace assembly, the member passes snugly through said opening.

In one embodiment of the fence brace assembly, the opening is located directly opposite to at least one tab-slot. In one embodiment of the fence brace assembly, the member is oriented at an angle of about 90° relative to said stabilizing surface. In one embodiment of the fence brace assembly, the member is oriented at a non-90° angle relative to said stabilizing surface. In one embodiment of the fence brace assembly, the opening is not directly opposite, but offset from at least one tab-slot.

In one embodiment of the fence brace assembly, the number of said tab-slots corresponds to the number of said tabs. In one embodiment of the fence brace assembly, the number of said tab-slots differs from the number of said tabs. In one embodiment of the fence brace assembly, the size and shape of said tab-slots corresponds to said tabs. In one embodiment of the fence brace assembly, the tabs align to said tab-slots.

In one embodiment of the fence brace assembly, the tabs are bent over an edge of said tab-slots to engage said tab-slots. In one embodiment of the fence brace assembly, the tabs are crimped over an edge of said tab-slots to engage said tab-slots. In one embodiment of the fence brace assembly, the tabs are glued in place in said tab-slots to engage said tab-slots.

In one embodiment of the fence brace assembly, the tabs may be welded in place in said tab-slots to engage said tab-slots. In one embodiment of the fence brace assembly, the tabs are pinned in place in the tab-slots to engage the tab-slots. In one embodiment of the fence brace assembly, the tabs may twist to lock and engage the tab-slots.

In one embodiment of the fence brace assembly, the fence brace assembly is produced by a process wherein said opening and said tab-slots are cut by laser or other means.

In one embodiment of the fence brace assembly, the fence brace assembly further comprises at least one recess in the securing surface.

In another embodiment, the present invention is directed to a method for assembling a fence brace assembly, comprising the steps of providing at least one post comprising a stabilizing surface and a securing surface, providing at least one member comprising at least one tab, providing at least one joint connection comprising an opening in a stabilizing surface, at least one tab-slot in a securing surface, wherein the member has at least one tab, passing said member through said opening, aligning at least one tab of said first member with at least one tab-slot on second member, and passing the tab into the tab-slot.

In one embodiment, the method for assembling a fence brace assembly further comprises providing two or more tabs protruding from said member. In one embodiment of the method for assembling a fence brace assembly, the tabs correspond in number to said tab-slots on said securing surface.

In one embodiment of the method for assembling a fence brace assembly, the tabs engage in corresponding tab-slots without requiring welding. In one embodiment of the method for assembling a fence brace assembly, the tabs engage in corresponding tab-slots without requiring additional fastening units. In one embodiment of the method for assembling a fence brace assembly, the method further comprises bending the tabs over an edge of the tab-slots.

In one embodiment of the method for assembling a fence brace assembly, the method further comprises crimping the tabs over an edge of the tab-slots. In one embodiment of the method for assembling a fence brace assembly, the method further comprises gluing the tabs in place in the tab-slots. In one embodiment of the method for assembling a fence brace assembly, the method further comprises optionally welding said tabs in place in the tab-slots.

In one embodiment of the method for assembling a fence brace assembly, the method further comprises passing a pin through the tabs on the exterior side of the tab-slots.

In one embodiment of the method for assembling a fence brace assembly, the method further comprises passing the member through the opening at approximately a 90° angle.

In one embodiment of the method for assembling a fence brace assembly, the method further comprises passing the member through the opening at a non-90° angle.

In one embodiment of the method for assembling a fence brace assembly, the method further comprises bending the tabs over an edge of the tab-slots into a recess in the securing surface, such that the tabs are flush with the securing surface or slightly above or slightly below the securing surface.

In yet another embodiment, the present invention is directed to a kit for assembling a fence brace assembly having component parts capable of being assembled in the field and adapted for use with a plurality of fence posts. The kit comprises at least one post, at least one member, at least one opening in each of said at least one post, at least one tab-slot in each of said at least one posts, and wherein said at least one member has at least one tab. The kit may be disassembled.

In one embodiment of the kit for assembling a fence brace assembly, the kit is capable of being assembled in a desired location. In one embodiment of the kit for assembling a fence brace assembly, the openings in the posts correspond in shape and size to the member.

In one embodiment of the kit for assembling a fence brace assembly, the tab-slots in the posts correspond in shape and size to the tabs. In one embodiment of the kit for assembling a fence brace assembly, the ends of the member are capable of being inserted into the openings of the posts. In one embodiment of the kit for assembling a fence brace assembly, the tabs on the member are capable of being fitted into the slots on the posts.

In one embodiment of the kit for assembling a fence brace assembly, the tabs on the member are capable of being bent over an edge of the tab-slots. In one embodiment of the kit for assembling a fence brace assembly, the tabs on the member are capable of being deformed over an edge of the tab-slots. In one embodiment of the kit for assembling a fence brace assembly, the tabs on the member are capable of being glued in place in the tab-slots.

In one embodiment of the kit for assembling a fence brace assembly, the kit further comprises a pin. In one embodiment of the kit for assembling a fence brace assembly, the tabs on the member are capable of being pinned in place in the tab-slots.

The foregoing has outlined rather broadly the features and technical advantages of the present invention in order that the detailed description of the invention that follows may be better understood. Additional objects, features, and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1A:
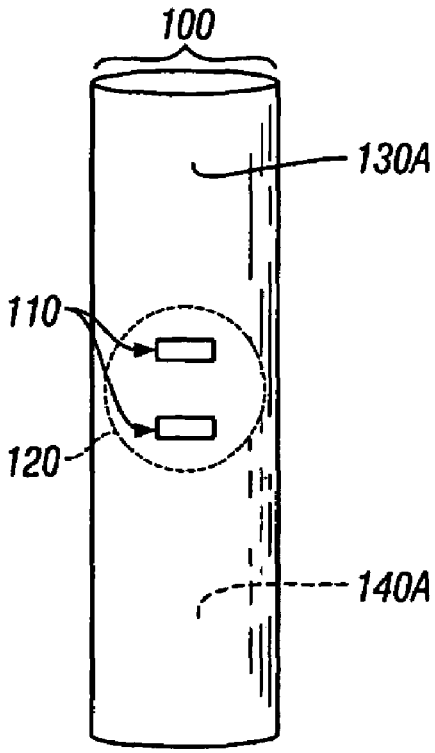
FIG. 1A is an illustrative view of one side of a post segment of the present invention.

Before the present invention is disclosed and described, it is to be understood that this invention is not limited to any specific materials or size. It is also to be understood that the terminology used herein is for the purpose of describing particular embodiments and is not intended to be limiting.

DEFINITIONS AND USE OF TERMS

In the specification and in the claims which follow, reference will be made to a number of terms which shall be defined to have the following meanings:

It should be noted that, as used in the specification and the appended claims, the singular forms "a," "an" and "the" include the plural form as well unless the context clearly indicates otherwise. Thus, reference to "a post segment" may include numerous post segments, for example, in a fence line, or the like. The terms "at least one," and "one or more" refer to the singular or the plural.

The term "post," as used herein, refers to one or more segments to which a common member is attached, and generally has both a stabilizing surface and a securing surface. A post may also refer to separate stabilizing and securing surfaces that are not part of a unified structure, but are used in combination. The term "post" as used herein may include, for example, a rod, a pole, a tube, a stake, a beam, a marker, a pair comprising a stabilizing surface and a securing surface, or a support of any kind. The term "post" refers to hollow, solid, and partially filled members. In one embodiment, the posts are galvanized, plain, plated or painted metal pipe, or are wood, plastic or cement, and are employed in the present invention as the vertical uprights serving as support. However, in other embodiments, the posts are not necessarily vertical uprights. In another embodiment, one end of the post may be buried underground or alternatively, cemented in place. In another embodiment, concrete or cement may be used to secure the end of the post in one place underground. In yet another embodiment, dirt may be tightly packed to secure the end of the post in one place underground. In another embodiment, the post may be driven into the ground. In another embodiment, the post may be bolted to studs protruding from concrete, wood, plastic or other material above or below ground level. In yet another embodiment, the post may include or comprise mesh tubing, for example, oil well screens and nanotube comprised of a mesh. In an embodiment having more than one post, posts may be dissimilar, for example, in composition and size.

The term "tab," as used herein, refers to any flange, projection, flap, protrusion, or the like, extending from a common member. The tab may vary in length, shape and thickness, material, color, hardness, coating, plating, painting, and the like, as necessary for the desired application, and may be comprised of different material than the member. The tab may be threaded to accept a nut, screwed thereon, for example, as a means of attachment. The tab may be made in any manner, such as, for example, by machining, laser cutting, protrusion, or molding. A tab may also include a hole, which may or may not be threaded. The tab may also be notched to allow it to engage with the tab-slot.

The term "tab-slot," as used herein, refers to any space, hole, groove, slit, or the like, in the securing surface that loosely corresponds in shape and size to tabs that are inserted into the tab-slot. In one embodiment, the tab-slots are cut with a laser. In another embodiment, the tab-slots may be made or obtained in any fashion, such as, for example, by boring through the securing surface, or prefabricated such as by molding, forging, casting, extruding or melting. In one embodiment, the tab-slot may be made by penetration by the tabs. In one embodiment, the tab-slot may not necessarily extend completely through to the outer surface of the securing surface; for example, the tab-slot could comprise a notch in the inner surface of the securing surface that engages a tab, or the tab-slot could be made by penetration of a tab into the inner surface of the securing surface, where the tab, and hence the tab-slot, do not extend completely through the securing surface to reach the outer surface of the securing surface.

The term "opening," as used herein, refers to any space, gap or hole in the stabilizing surface that may correspond in shape and size to the common member that is inserted into the opening, although the opening may vary in size or shape as necessary with regard for the desired application. In one embodiment, the opening is cut with a laser. In another embodiment, the opening may be made or obtained in any fashion, such as for example, by boring through the securing surface, or prefabricated such as by molding. The term "opening" as used herein includes a hole passing through a solid object, or a hole through the outer surface of a hollow object. Furthermore, the opening does not necessarily remain "open" in all stages of the invention. For example, when the joint is assembled, the member is in the opening; further, for example, in some embodiments, the opening in the assembled joint connection may be sealed. In one embodiment, the opening may be made by penetration by the member.

The term "member," as used herein, refers to an object capable of penetrating a hole of any shape, and may include, for example, a rail, a bar, a brace, a pipe, a rod, a beam, a tube, a pole, or the like. The term "member" refers to hollow, solid and semi-filled objects. In one embodiment, the member connects to a post. In one embodiment, the member is the horizontal portion connecting at least two posts to provide stability and support, for example, to a fence brace and fence. In an embodiment having more than one member, members may be dissimilar, for example, in composition and size.

The term "pin," as used herein, refers any object capable of securing a tab to a tab-slot, and may include, for example, a slender, usually cylindrical piece of wood or metal for holding or fastening parts together, screws, nuts and bolts, nails, pegs, wire (e.g., stiff or malleable) and various other hardware typically used for fastening parts together, such as, for example, pins, clips, or split rings.

The term "couple," as used herein, refers to joining, securing, connecting, or the like, items together or alternatively, joining, securing, connecting, or the like, a single item to itself. "Couple," "coupled" or "coupling" is not limited to irreversible attachment; "couple" may refer to reversible joining, securing, connecting, or the like.

The term "attach," as used herein, refers to joining, securing, connecting, or the like, items together or alternatively, joining, securing, connecting, or the like, a single item to itself.

The term "fasten," as used herein, refers to joining, securing, connecting, or the like, items together or alternatively, joining, securing, connecting, or the like, a single item to itself.

The terms "couple," "attach," "fasten," "join," "joint," and "engage" are not limited to permanent connections.

The term "engage," as used herein, means to interlock or mesh or cause to interlock or mesh, weave, entwine, bind or thread.

The term "bent," as used herein, refers to the tab assuming a different direction or shape. In one embodiment, the act of bending the tab may be accomplished using a mallet, hammer or pliers or other tools or processes, whether specifically designed for the task or not, whereby the tab bends around the tab-slots to secure the member.

The term "crimped," as used herein, refers to pressing, pinching or otherwise deforming the tab to engage the tab with the tab-slot. In one embodiment, the act of crimping the tab may be accomplished using a mallet, hammer or pliers or a special tool or process.

The term "glued," as used herein, refers to fastened with any type of adhesive. In one embodiment, an adhesive such as epoxy glue, skin glue, bone glue, BONDO®, Bondo Corporation, Atlanta, Ga., and the like, may be used.

The term "sealant," as used herein, refers to a substance, agent or device that joins items so as to prevent leakage, close in an air-tight fashion, make waterproof, or the like, and may include, for example, caulking agents, a rubberized O-ring, or specialty rubber seals such as Jons Mansfield rubber or a Mansfield seal.

The term "stabilizing surface," as used herein, refers to any object capable of fixing another item, such as a member, for example, by preventing fluctuation, variation and resistant to movement, and may include, for example, the outer surface of a post, any part of or all of a post, a surface that is separate from and not connected to a securing surface, or a surface that may be connected to a securing surface. The term "stabilizing surface" is not limited to a surface or face of any material, item or such, and relates to any part of any material, item, or such, that has an opening that fixes another item, such as a member.

The term "securing surface," as used herein, refers to any object capable of firmly fastening, locking, coupling, attaching or otherwise anchoring another item, such as a member, in place, and may include, for example, the outer surface of a post, any part of or all of a post, a surface that is separate from and not connected to a stabilizing surface, or a surface that may be connected to a stabilizing surface. The term "securing surface" is not limited to a surface or face of any material, item or such, and relates to any part of any material, item, or such, that has tab-slots that fasten, lock, couple, attach, or otherwise anchor another item, such as, for example, a member, in place.

The term "snugly," as used herein, refers to closely secured or closely fitting, and not loose.

The term "substantially," as used herein, is a term of approximation, and means for the same as or very close to that which is specified.

The term "about," as used herein, is a term of approximation, and means reasonably close, approximately, or near.

The terms "joint," and "joint connection," as used herein, refer to a link, point, or other type of attachment between two ore more items, where fastening or coupling may take place.

The term "construction," as used herein, includes, but is not limited to, materials for structural strengthening designs such as support beams for roofing; support beams of airplane wings; tent-like structures, temporary buildings and hunting units such as deer stands and deer blinds; outdoor venue applications; commercial fishing applications; animal pens and fence structures; space station or space craft applications; helix-type designs; medical and/or surgical devices; agricultural grain storage and handling; ladders; antennas; water towers; irrigation equipment (for example, center pivots); petro-chemical storage tanks; highway signage structures; automotive components; motorcycle, bicycle, tricycle, and unicycle components; wildlife feeder structures; cattle handling and milking equipment; animal laboratory equipment; feedlots; all types of gates, architectural railing, fencing, stair rails, catwalks, and safety railing; scaffolding; isotainer frames; light beacon towers; construction equipment; conveyor framework of all types; sand, gravel, rock crushing equipment framework, concrete forms, oilwell perforating tubes, railroad trucks, bridges, boats, ships, and shipping containers, such as, for example, ISO containers; and can also be architectural, ornamental or artistic in design and not necessarily made for stability or strength.

FIG. 1A is an illustrative view of one embodiment of the invention and shows one side of a post segment 100 of the present invention. In the figure, on the near side of the post segment 100, one or more tab-slots 110 in a securing surface 130A are shown. Opposite the one or more tab-slots 110, on the far side of the post segment 100, an opening 120 in a stabilizing surface 140A is shown. The one or more tab-slots 110 are not required to be directly across from the opening 120, but may be offset to allow fastening of materials at various angles.

Figure 1B:
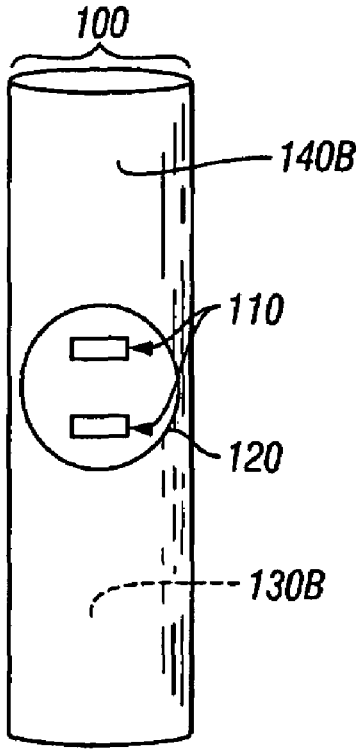
FIG. 1B is an illustrative view of the opposite side of a post segment of the present invention.

FIG. 1B is an alternative illustrative view of the opposite side of a post segment of the present invention. In the figure, on the near side of the post segment 100, an opening 120 in a stabilizing surface 140B is shown. Opposite the opening 120, on the far side of the post segment 100, one or more tab-slots 110 in a securing surface 130B are shown. Again, the one or more tab-slots 110 are not required to be directly across from the opening 120, but may be offset to allow fastening of materials at various angles.

In one embodiment shown in FIG. 1A and alternatively shown in FIG. 1B, the openings and tab-slots are cut into tubing used for post segments using a laser, and the tubing is later galvanized. Particularly useful for cutting the tab-slots and openings is the 6-Axis tube laser, and the like, available from Mazak Corporation, www.mazakusa.com.

In one embodiment, the edge of the opening 120 may be lined with a sealant. A sealant may be added along the edge of the opening 120 in any application wherein it is desirable to prevent fluids, gases, or dry materials from accumulating inside the post segment, or alternatively, keep such materials in. A sealant may be particularly desirable in any application wherein caustic materials are used to clean the joint connection. In another embodiment, the tab-slots 110 may be lined with a sealant, for similar reasons. In particular, a silicon sealant may be used.

Figure 2:
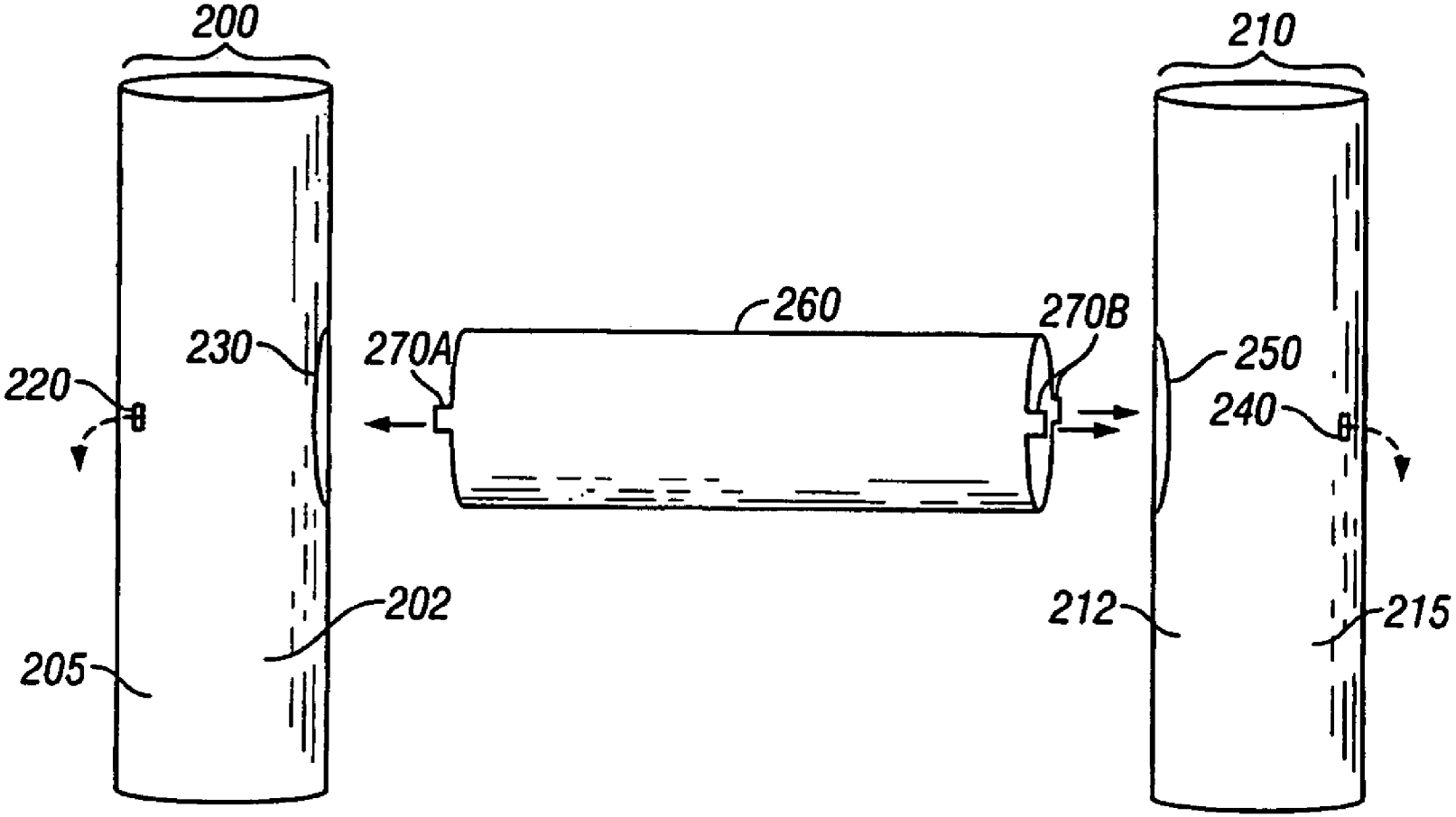
FIG. 2 is an exploded view of one embodiment of the present invention.

FIG. 2 is an exploded view of one embodiment of the present invention. A first post segment 200 is shown, as well as a second post segment 210. The first post segment 200 has one or more tab-slots 220 in a securing surface 205 and an opening 230 in a stabilizing surface 202, as shown, the side opposite to the tab-slots 220. The tab-slots 220 on the first post segment 200 may be of any size, shape, and number, depending on what is necessary for the particular application. The second post segment 210 has one or more tab-slots 240 in a securing surface 215 and an opening 250 in a stabilizing surface 212, as shown, on the side opposite to the tab-slots 240. The tab-slots 240 of the second post segment 210 also may be of any size, shape, and number, depending on what is necessary for the particular application. A member 260 is shown, to be coupled to the first post segment and the second post segment. The member 260 also includes tabs 270A on one end, and tabs 270B on the other end. The opening 230 in the first post segment 200 and the opening 250 of the second post segment 210 correspond in shape and size to the common member 260, according to the various needs for the particular application.

In one embodiment of the present invention, the member may be a capillary tube and/or be of capillary tube dimensions, for example, having a diameter measured in the micron range. In one embodiment, the member is at least one capillary tube having at least one tab protruding from its end. The member may also have a hole, or other such structure, located near the tabs. In one embodiment, the member is used, for example, in obtaining a blood sample. In one such embodiment, the member may be used to pierce a hole in the wall of a blood vessel, and the tabs used to pierce the opposite wall of the blood vessel. In this way, the inventive joint may be constructed using a capillary tube as the member, and the walls of a blood vessel or capillary as the supporting and stabilizing surfaces. For example, insertion of the member into a blood vessel creates the opening in the supporting surface of the blood vessel, and piercing by the tabs creates the tab-slots in the securing surface of the opposite wall of the blood vessel—thus forming the inventive joint connection. When, for example, such a capillary tube is inserted into a blood vessel, the tube may also contain a hole or other structure located near the tab end, such that, when the member is inserted into a blood vessel and the tabs are inserted in the tab-slots—forming the inventive joint connection—the hole or other structure is located such that it is within the interior of the blood vessel, and thus within the flow of blood. In one embodiment, for example, by appropriately designing the hole or other structure, it can be used to obtain a blood sample or to obtain one or more other specific types of samples from the blood. For example, the hole could be sized such that it accepts red blood cells but not white blood cells. This would provide for a means of selectively sampling RBCs in an animal, including humans, with minimal effort and minimal invasiveness. For example, the diameter of the hole on the capillary tube could be, for example, about 5 microns. It is known in the art that RBCs may pass through an opening of about this size, while WBCs will not. This thus provides a method for selectively collecting RBCs from the blood of a living animal with minimal effort and invasiveness. In another embodiment, the hole may receive certain blood gases or plasma, making a device and method for selectively measuring and/or obtaining a specific blood component in an animal, such as a human, livestock or a companion animal. In a similar manner, the invention may be used to introduce compounds into the blood stream, such as drugs or sensors, such as dyes, and the like. The device may also be used as a probe or sensor.

In one embodiment, the member and other components of the joint connection are in the nanoscale range of size, for example, having dimensions measured in nanometers, or smaller. This may include, for example, molecular manufacturing, molecular devices and use of such, as well as, for example, devices on the molecular and atomic scale.

Figure 4A:
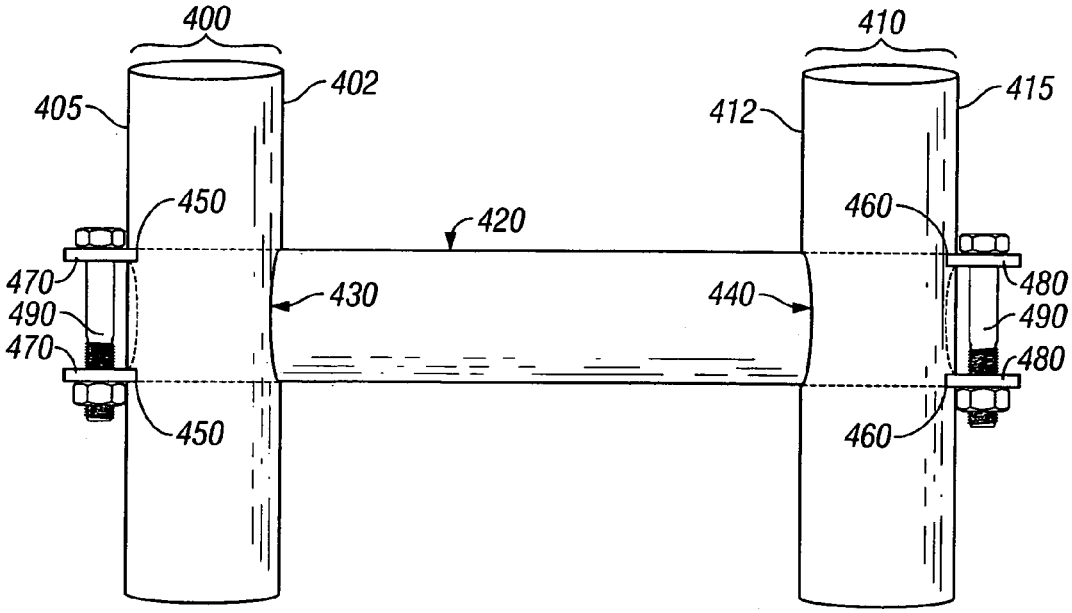
FIG. 4A is an illustrative view of yet another embodiment of the present invention showing three components securely coupled together with a pin securely coupling together the tabs after passing through tab-slots.
Figure 4B:
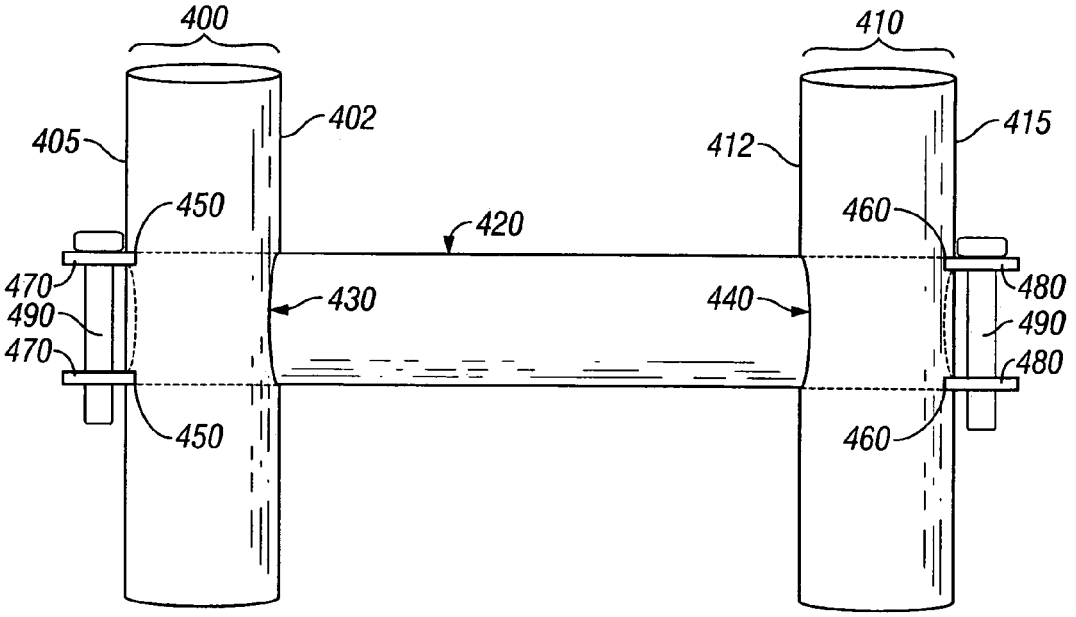
FIG. 4B is an illustrative view of another embodiment of the present invention showing a simple pin inserted through the tabs to hold the tabs in the tab-slots.

In one embodiment of the present invention, one end of the member 260 is inserted into the opening 230 in a stabilizing surface 202 of the first post segment 200. The member 260 passes through the first post segment 200. The member 260 is aligned with the first post segment 200 such that the member 260 fits through the opening 230 in a stabilizing surface 202, and the tabs 270A can be inserted into the tab-slots 220 in a securing surface 205. Also in one embodiment of the present invention, the other end of the common member 260 is inserted into the opening 250 in a stabilizing surface 212 of the second post segment 210. The common member 260 passes through the second post segment 210. The common member 260 is also aligned with the second post segment 210 such that the common member 260 fits through the opening 250 in the stabilizing surface 212, and the tabs 270B can be inserted into the tab-slots 240 in the securing surface 215. In the embodiment shown in FIG. 2, the tabs 270A and 270B may be bent, crimped, twisted, rotated, for example to engage a notch, or glued in place to securely fasten the members. Alternatively, the tabs may also be pinned or screwed together to securely fasten the members as shown in FIG. 4A and 4B. Additionally, the member 260 may be symmetrical, such that the ends may fit to either post, and the member may be attached regardless of the orientation in which it is inserted through the openings 230 and 250. Alternatively, the member 260 may be asymmetrical.

Passing the common member 260 through the opening in each post segment affords an added measure of stability, and adds to the load bearing capacity of the present invention. Inserting the tabs into the tab-slots in each post segment affords a locking capacity to allow the members to be coupled together. This, for example, also increases the ability of the joints to retain the desired design, for example, squareness, and the like.

The first post segment 200, the second post segment 210 and the member 260 may be composed of various and/or different materials, such as, for example, galvanized tubing, metal, plastic, wood composites, paper, cardboard, tissue, silicone, glass, teflon, clay, concrete, rubber, vinyl, carbon and carbon molecules, ceramic, woven wire, woven materials, woven tubing. Particularly, the first post segment 200, the second post segment 210 and the member 260 may be composed of painted tubing. The size of all of the components can vary anywhere from very small, for applications in the field of nano-technology, all the way to very large, for applications in, for example, building framing, scaffolding, large farm gates, and airport fencing or containment assemblies. In one preferred embodiment, the components are less than 11" in diameter and less than 24' long. The various components of the present invention may be hollow, to allow for lightweight construction, or may be solid, to provide added stability and sturdiness.

In one embodiment, the tabs may be used, for example, both as tabs, as defined herein for engaging a tab-slot, and as saw teeth. For example, the tab end of the member could have one or more angled, sharpened, or sawtooth-like tabs. In this embodiment, the tab end of the member may resemble the sawtooth end of a hole saw. In assembling the inventive joint connection, the member may be rotated such that the tabs cut an opening in the stabilizing surface. Penetration of the opening by the member then allows for the tabs to engage in tab-slots in the stabilizing surface; these tab-slots may be preexisting or may be made by the tabs, for example, by penetration of the tabs. In one embodiment, the tab-slots may extend though the stabilizing surface such that the tabs may extend to or beyond the outer surface of the stabilizing surface. In such an embodiment, the tabs may be engaged with the tab-slots in the stabilizing surface as discussed herein, for example, by bending, twisting or crimping. In another embodiment, the tab-slots may only penetrate the inner surface of the stabilizing surface, such that the tabs are secured in the tab-slots. These embodiments, as with others described herein, may be used in a wide variety of applications, ranging from, for example, use in large scale mechanical structures to small biotechnology uses, such as, for example, bone stabilizing devices or internal body probes or sensors.

Figure 3A:
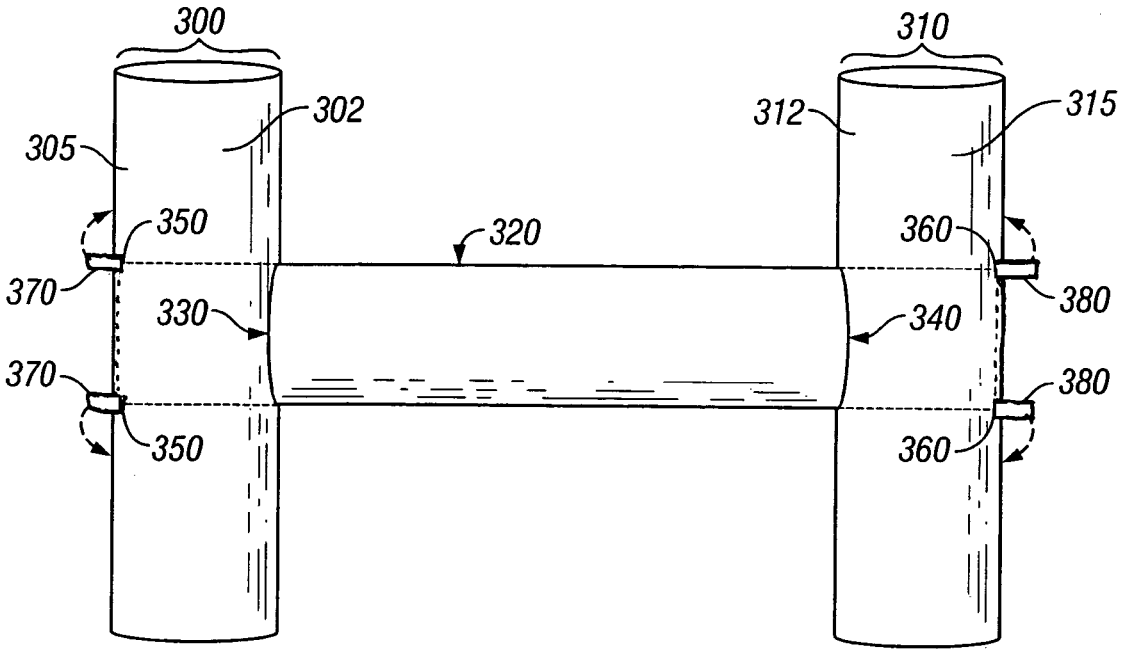
FIG. 3A is an illustrative view of one embodiment of the present invention wherein tabs are aligned with tab slots and inserted into tab-slots.

FIG. 3A is an illustrative view of one embodiment of the present invention wherein tabs are aligned with and inserted into tab-slots. The first post segment 300 and the second post segment 310 can be coupled together by common member 320. The common member 320 is inserted into an opening 330 in a stabilizing surface 302 on the first post segment 300 and an opening 340 in a stabilizing surface 312 on the second post segment 310. As shown in FIG. 3A, the common member 320 passes through both the first post segment 300 and the second post segment 310. On the opposite side to the opening 330, tab-slots 350 are in a securing surface 305 of the first post segment 300. Tabs 370 on the end of common member 320 are inserted into the tab-slots 350. The tabs 370 may extend all the way through the tab-slots 350 to the exterior of the first post segment 300, or may be longer to extend out of the tab-slots or shorter to be flush with the securing surface. On the opposite side to the opening 340 of the second post segment 310, tab-slots 360 are in a securing surface 315 of the second post segment 310. Tabs 380 on the end of common member 320 are inserted into the tab-slots 360. The tabs 380 may extend all the way through the tab-slots 360 to the exterior of the second post segment 310, or may be longer to extend out of the tab-slots or shorter to be flush with the securing surface.

In one embodiment, the tab end of the member may be cut such that it fits flush against the inner surface of the stabilizing surface when the tabs are engaged with the tab-slots. For example, if the stabilizing surface is on a hollow post, the tab end of the member could be cut such that it fits flush against the internal diameter of the stabilizing surface when the tabs are engaged in the tab-slots. One example is shown in FIG. 3A, wherein the tab ends of common member 320 fit flush against the inner surfaces/inner diameters of securing surfaces 305 and 315 when the tabs are engaged in the tab-slots. In an optional embodiment, the flush fitting of the tab end of the member with the inner surface (e.g., inner diameter) of the stabilizing surface may be sealed, for example, with a silicon sealer or similar sealing means.

Figure 3B:
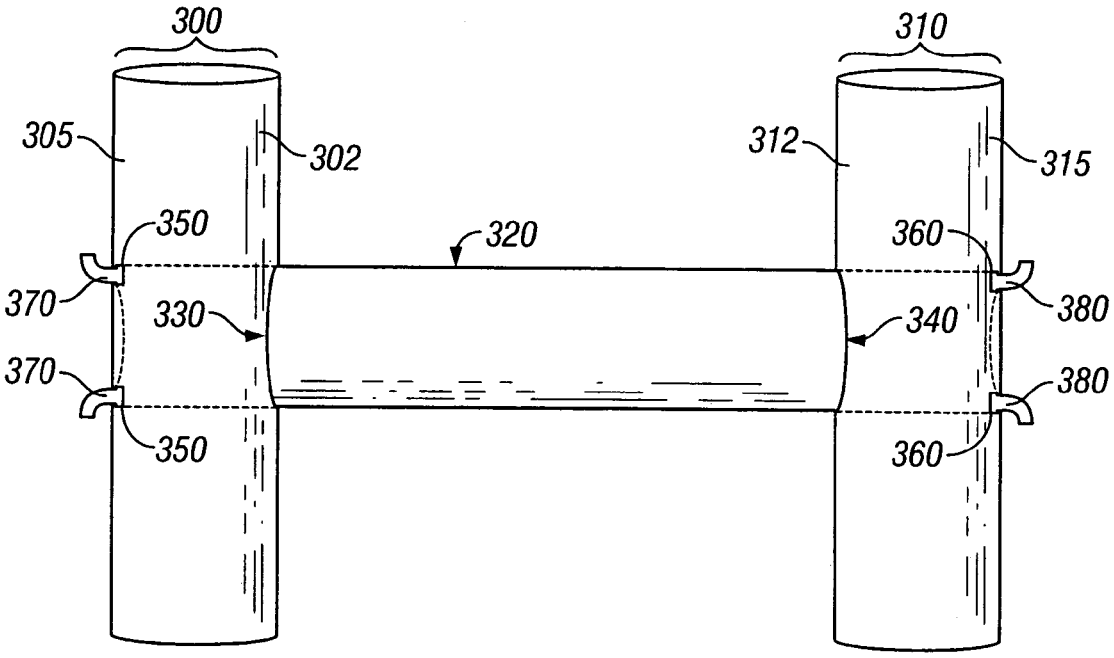
FIG. 3B is an illustrative view of one embodiment of the present invention showing three components securely coupled together with tabs bent after passing through tab-slots.

FIG. 3B is an illustrative view of one embodiment of the present invention showing three components securely coupled together with tabs deformed after passing through tab-slots. After the tabs 370 and 380 on each end of the common member 320 are aligned and inserted into the tab-slots 350 and 360, the tabs 370 and 380 are deformed by bending, crimping, twisting, gluing, engaging a notch, for example, by rotating the member, or other method to lock the members into place in the securing surfaces 305 and 315. This may be done by heating the tabs and/or using, for example, a hammer, mallet, rock, gun butt, wrench, shovel, spent artillery shell case, junk iron, among other tools or items that one may find useful. The method of locking the tabs 370 and 380 into place may depend on the material used to comprise the common member 320 or according to need for the particular application, for example, if the tabs 370 and 380 will need to be unlocked at any point in time, or moved and reassembled in another arrangement.

Figure 3C:
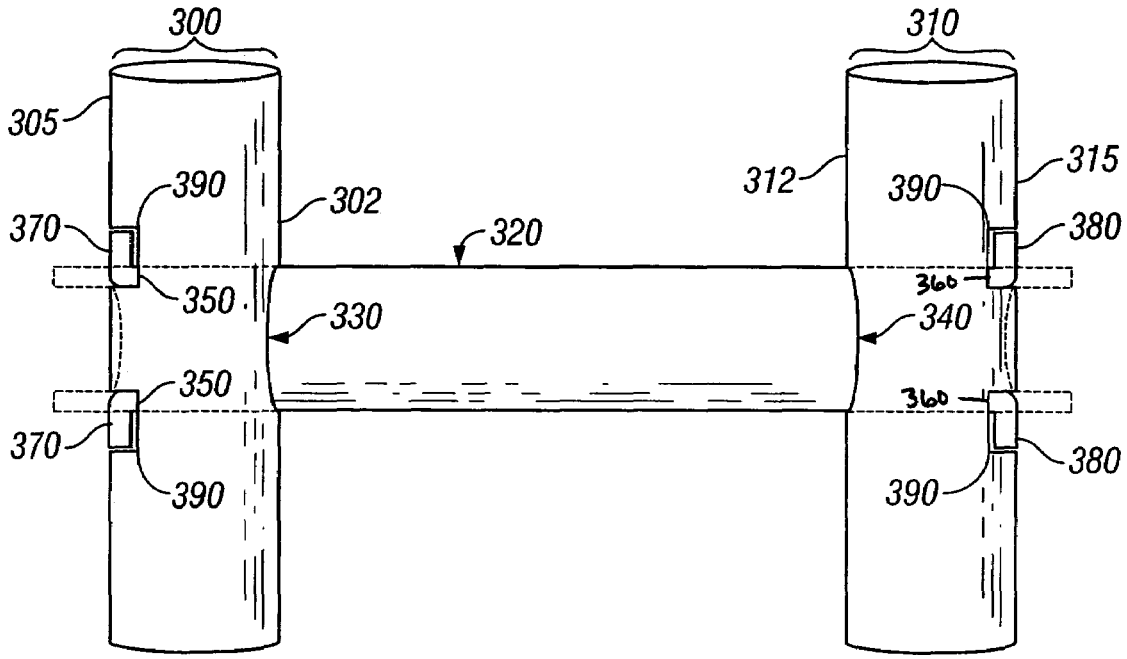
FIG. 3C is an illustrative view of one embodiment of the present invention showing three components securely coupled together with tabs deformed after passing through tab-slots, where tabs are deformed in a recess to be flush with the securing surface.

FIG. 3C is an illustrative view of one embodiment of the present invention showing three components securely coupled together with tabs deformed after passing through tab-slots, where tabs are deformed in a recess to be flush with the securing surface. In the securing surfaces 305 and 315, there are recesses 390 adjacent to each tab-slot 350 and 360. After the tabs 370 and 380 on each end of the member 320 are aligned and inserted into the tab-slots 350 and 360, the tabs 370 and 380 are deformed by bending, crimping, twisting, gluing or other method to lock the members into place in the securing surfaces 305 and 315. This may be done by heating the tabs and/or using, for example, a hammer, mallet, rock, gun butt, wrench, shovel, spent artillery shell case, junk iron, among other tools or items that one may find useful. The tabs 370 and 380 are bent or crimped into the recesses 390 such that the tabs 370 and 380, once secure, lay flush more or less with the securing surfaces 305 and 315. The method of locking the tabs 370 and 380 into place may depend on the material used to comprise the member 320 or according to need for the particular application, for example, if the tabs 370 and 380 will need to be unlocked at any point in time, or moved and reassembled in another arrangement.

FIG. 4A is an illustrative view of yet another embodiment of the present invention showing three components securely coupled together with a nut and bolt securely coupling together the tabs after passing through tab-slots. A first post segment 400 is coupled to a second post segment 410 by a member 420 with tabs 470 protruding from one end and tabs 480 protruding from the other end. One end of the member 420 is inserted through an opening 430 in a stabilizing surface 402 in the first post segment 400 and the other end of the member 420 is inserted through an opening 440 in a stabilizing surface 412 in the second post segment 410. The member 420 passes through both the first post segment 400 and the second post segment 410. On the side opposite to the opening 430, there are tab-slots 450 in a securing surface 405 on the first post segment 400. When the member 420 is aligned properly, the tabs 470 fit through the tab-slots 450. On the side opposite the opening 440, there are tab-slots 460 in a securing surface 415 on the second post segment 410. When the member 420 is aligned, the tabs 480 fit through the tab-slots 460. In the embodiment shown in FIGS. 4A and 4B, the tabs 470 and 480 contain holes through which a pin, screw, rivet, split ring, pin ring, cam bolt, or any other type of fastener 490 may be placed. Such holes may additionally be threaded. In the embodiment shown in FIG. 4A using a fastener that is not incorporated into the member 420, the advantage is that one may take the entire assembly apart, move it around, and reassemble it as many times as necessary, and re-assembly will not require welding or special skills.

In the embodiment shown in FIG. 4B, a simple pin 490 may alternatively be inserted through the tabs 470 and 480 to hold the tabs 470 and 480 in the tab-slots 450 and 460. Alternatively, a pin 490 may lock the tab in place by using a cam action. For example, pin 490 or the like, may have an asymmetrical component, such as a cam bolt, cam nut, cam socket head, or other portion having a cam-like, offset protrusion, wherein when the pin or the like is turned, the offset cam component becomes wedged against the outer surface of the stabilizing surface, thereby it locking the tab in place. Alternatively, a pin 490 may be threaded, and placed through one or more threaded holes in the tabs 470 and 480. For example, where a threaded pin or the like passes through two opposing tabs, one hole in one tab may be a non-threaded through hole and the opposing hole be threaded, for accepting and securing the threaded pin.

Figure 4C:
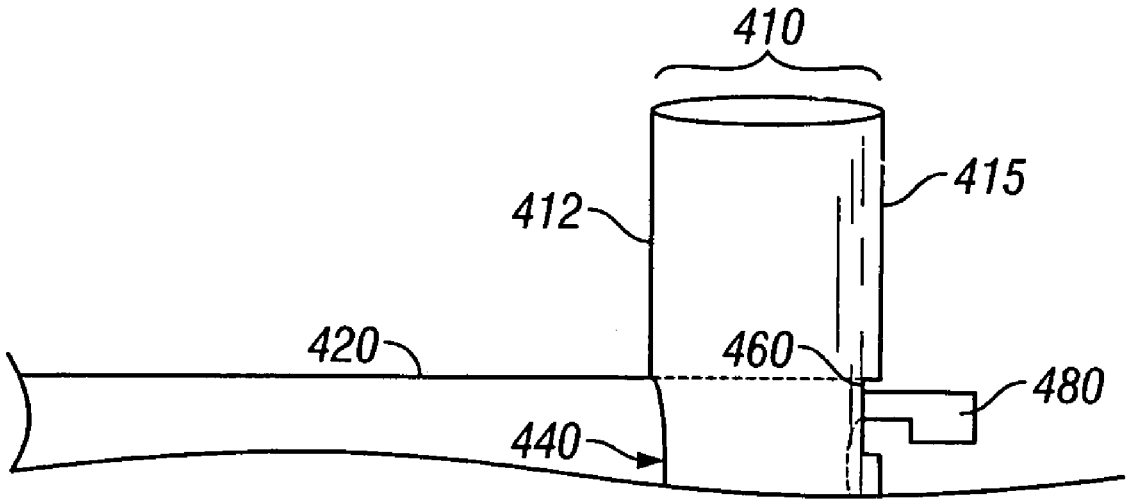
FIG. 4C is an illustrative view of another embodiment of the present invention showing a notch in the tab, such that when the tab is inserted through the tab-slot in the securing surface, the notch in the tab engages with an edge of the corresponding tab-slot, for example, upon rotation of member 420.

In the alternative embodiment shown in FIG. 4C, the tabs 480 may also comprise a notch, such that when the member 420 is inserted through the opening 440 in the stabilizing surface 412 and the tabs 480 are inserted through the tab-slots 460 in the securing surface 415, the notch in each of the tabs 480 engages with an edge of the corresponding tab-slots 460. The notch may be oriented in many different directions relative to tab-slots 460 (e.g., top, bottom, or sides), so long as at least one tab 480 engages tab-slot 460 via the notch. In one embodiment, the member may be rotated to engage the tab with the tab-slot via the notch. In another embodiment, a common member, such as common member 420 for example, may have notched tabs on each end, with the notches oriented such that rotation of the member in one direction engages notched tabs on both ends of the common member with their corresponding tab-slots.

In another embodiment, the tab may be spring-like, such that it compresses when inserted into and through the tab-slot from the internal side of the securing surface, and then, once through the slot, expands on the outer surface of the securing surface, and secures the tab in place. In such an embodiment, the sprint-like tab may reversibly or irreversibly engage the tab in the tab-slot.

Figure 5:
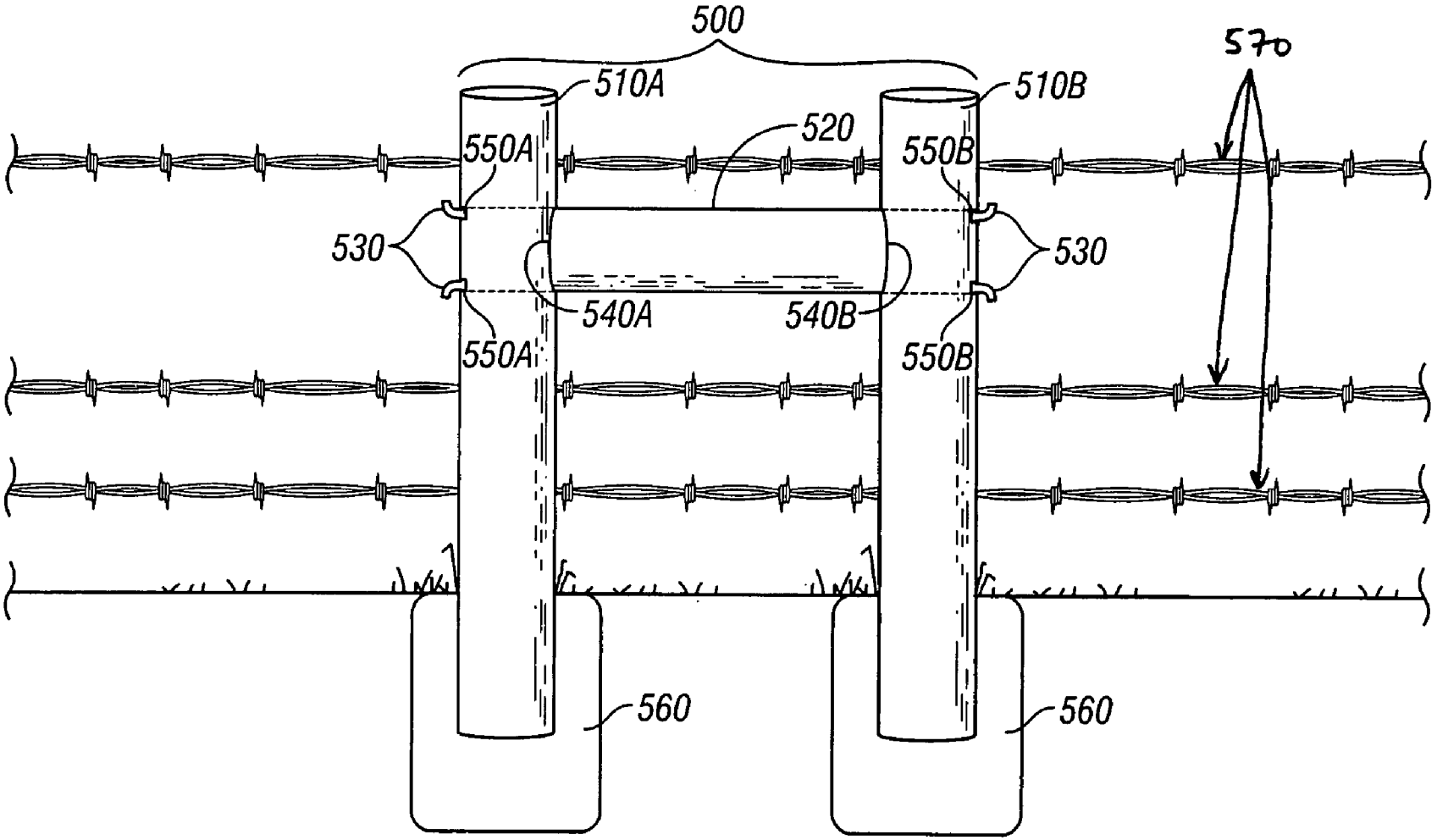
FIG. 5 is a side elevation of an H-post fence brace according to the present invention.

FIG. 5 is a side elevation of an H-post fence brace according to the present invention. A fence brace 500 is shown, including upright metal posts 510A and 510B. Posts 510A and 510B have openings 540A and 540B respectively, and tab-slots 550A and 550B. A member 520 has tabs 530 for fastening member 520 to posts 510A and 510B. In one method of installing the fence brace 500, member 520 is inserted into openings 540A and 540B, and tabs 530 are aligned with tab slots 550A and 550B. Tabs 530 are inserted into tab-slots 550A and 550B. In one method of installing the fence brace 500, the tabs 530 are deformed to lock the member 520 to the posts 510A and 510B. In an alternative method of installing the fence brace 500, the tabs 530 are pinned to lock the member 520 to the posts 510A and 510B. In yet another alternative method of installing the fence brace 500, the tabs 530 are glued in place in the tab slots 550A and 550B to lock the member 520 to the posts 510A and 510B. When the member 520 is locked to the posts 510A and 510B, the resulting structure is a rigid H-shaped structure, and the posts 510A and 510B are sunk into holes in the ground and firmly cemented into place with cement 560. A fence is then completed by stringing barbed wire 570 from the fence brace down the line to the next adjacent, similar fence brace. The assembly of the fence brace 500 is completed without requiring welding, and may even be completed by a single person without significant difficulty.

In the embodiment shown in FIG. 5, the resulting structure is H-shaped, with approximately a 90 degree angle between the member 520 and the posts 510A and 510B. As will be shown, the member 520 may also be coupled to the posts at various angles, as desired for the application, and the joint connection of the present invention is not limited to perpendicular connections.

As shown in FIG. 5, in one embodiment the posts 510A and 510B are structural tubing or galvanized pipe, marketed and sold by Jorgenson Steel as Hot Rolled Electric Welded Tube. In one embodiment, the posts 510A and 510B have a diameter of 3.5", and are approximately 14' long, with a significant portion of the length extending underground to anchor the post in the cement 560. Additionally, in one embodiment, the member 520 is structural tubing or pipe, with a diameter of about 2⅜" and about 10', 10¼" long. In one embodiment, the openings 540A and 540B as well as the tab-slots 550A and 550B are cut into the tubing using a laser After the laser cutting procedure, the tubing or pipe may be galvanized, painted, plated, or powder coated on all sides.

Figure 6:
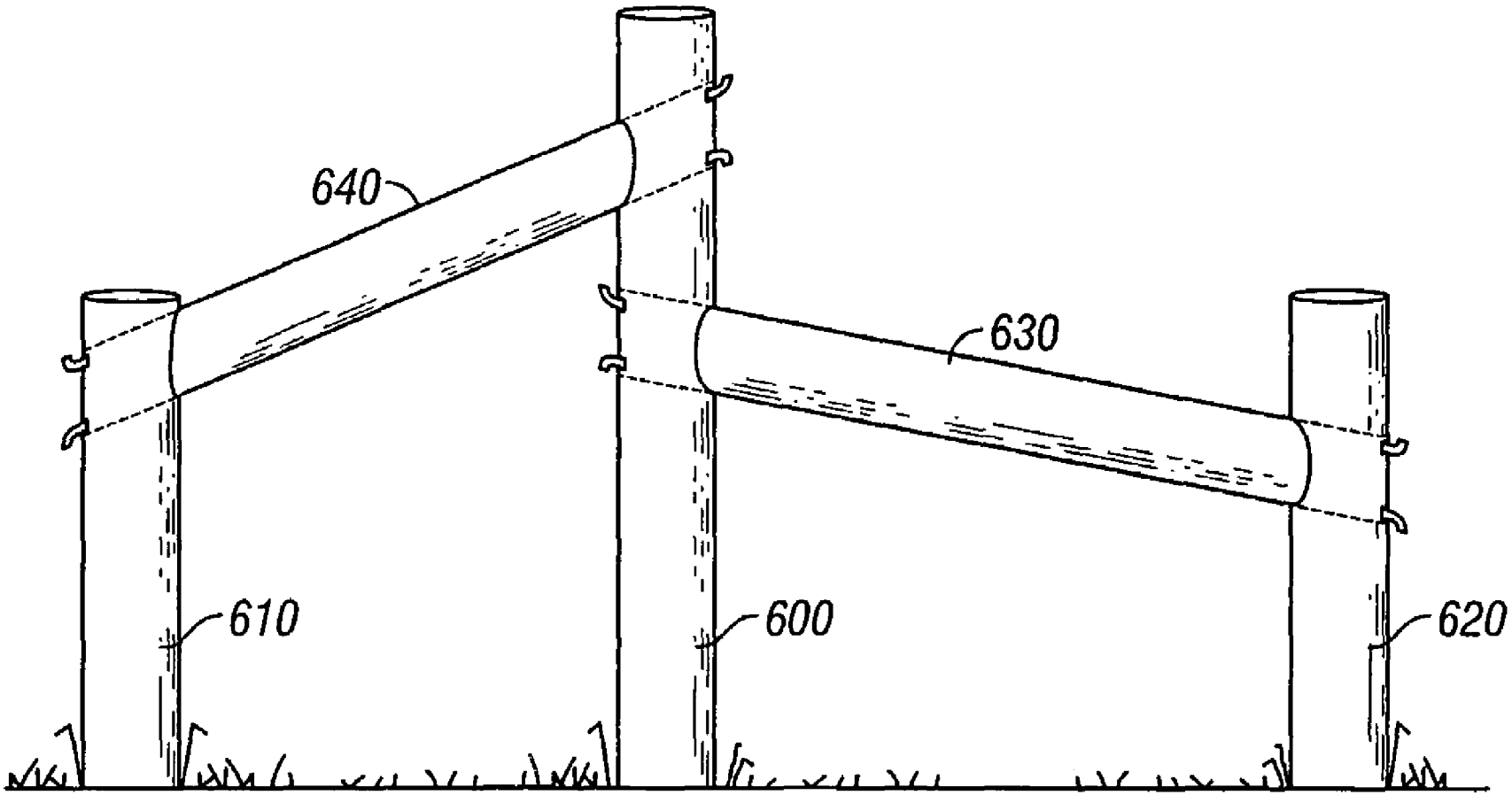
FIG. 6 is a side elevation of a line brace assembly according to the present invention.

FIG. 6 is a side elevation of a line brace assembly according to the present invention. In the embodiment shown in FIG. 6, there is a center brace post 600, and two brace foot posts 610 and 620. An angle brace post 630 connects the center brace post 600 to the brace foot post 620. Another angle brace post 640 connects the center brace post 600 to the other brace foot post 610.

As shown in FIG. 6, in one embodiment the posts 600, 610 and 620 are structural tubing or galvanized pipe, marketed and sold by Jorgenson Steel as Hot Rolled Electric Welded Tube. In one embodiment for a four foot pipe line brace assembly, the two brace foot posts 610 and 620 are metal tubing with a diameter of 2⅜" and 4' long. In the embodiment for a four foot pipe line brace assembly, the center brace post 600 is metal tubing with a diameter of about 2⅜" and about 7', 6" long. In one embodiment for a four foot pipe line brace assembly, the two angle braces 630 and 640 are metal tubing with a diameter of about 1½", and are about 7', 6" long. In one embodiment for a four foot pipe line-brace assembly, the openings, tabs, shaped tab end of members (for fitting flush with securing surface), and tab-slots for locking the members together according to the present invention are cut into the tubing using a laser, after which the tubing may be galvanized, painted, plated, or power coated.

In an alternative embodiment for a six foot pipe line brace assembly, the two brace foot posts 610 and 620 are metal tubing with a diameter of about 3½" and about 4', 6" long. In an alternative embodiment for a six foot pipe line brace assembly, the center brace post 600 is metal tubing with a diameter of about 3½" and about 10', 6" long. In an alternative embodiment for a six foot pipe line brace assembly, the two angle braces 630 and 640 are metal tubing with a diameter of about 2⅜", and angle brace 640 is about 11' long while angle brace 630 is 10', 8" long. In an alternative embodiment for a six foot pipe line brace assembly, the openings and tab-slots for locking the members together according to the present invention are cut into the tubing using a laser, after which the tubing may be galvanized, painted, plated, or power coated on all sides.

In yet another alternative embodiment for an eight foot pipe line brace assembly, the two brace foot posts 610 and 620 are metal tubing with a diameter of 3½" and 6' long. In an alternative embodiment for an eight foot pipe line brace assembly, the center brace post 600 is metal tubing with a diameter of about 3½" and about 14' long. In an alternative embodiment for an eight foot pipe line brace assembly, the two angle braces 630 and 640 are metal tubing with a diameter of about 2⅜", and angle brace 640 is about 16' long while angle brace 630 is about 15', 3" long. In an alternative embodiment for an eight foot pipe line brace assembly, the openings, tabs, shaped tab end of members (for fitting flush with securing surface), and tab-slots for locking the members together according to the present invention are cut into the tubing using a laser, after which the tubing may be galvanized, painted, plated, or power coated.

Figure 7:
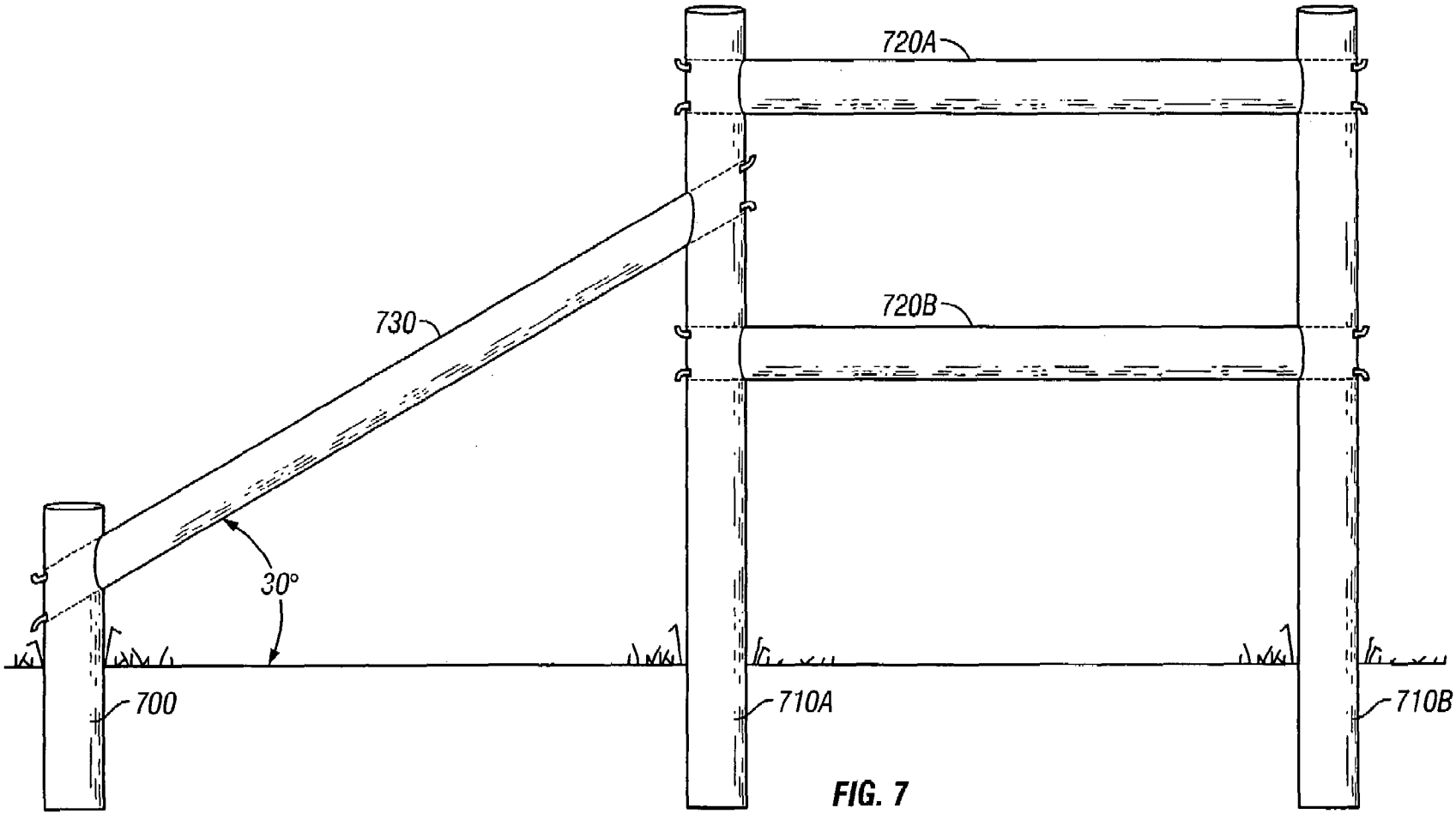
FIG. 7 is a side elevation of a pipe brace assembly according to the present invention.

FIG. 7 is a side elevation of a pipe brace assembly according to the present invention. In the embodiment shown in FIG. 7, there is an angle brace foot post 700 and two brace posts 710A and 710B. An angle brace 730 connects the angle brace foot post 700 and brace post 710A, where the angle brace 730 is at about a 30 degree angle relative to the ground. Members 720A and 720B connect brace posts 710A and 710B.

In one embodiment for about an 8' double H-post pipe brace assembly, as shown in FIG. 7, the foot brace 700 is metal tubing with a diameter of about 3.5" and about 6'6" long. The two brace posts 710A and 710B are metal tubing with a diameter of about 3.5" and about 14' long. The angle brace 730 is metal tubing with diameter of 2⅜" and 13'3" long set into the angle brace foot post at about a 30° angle relative to the ground once installed. The two members 720A and 720B are metal tubing with a diameter about 2⅜" and about 10' 10¼" long. The metal tubing may optionally be galvanized, painted, plated, or power coated after any necessary cutting is completed, if cutting is performed by a laser. The member 720B may be omitted to construct a single H-post pipe brace assembly.

Figure 8:
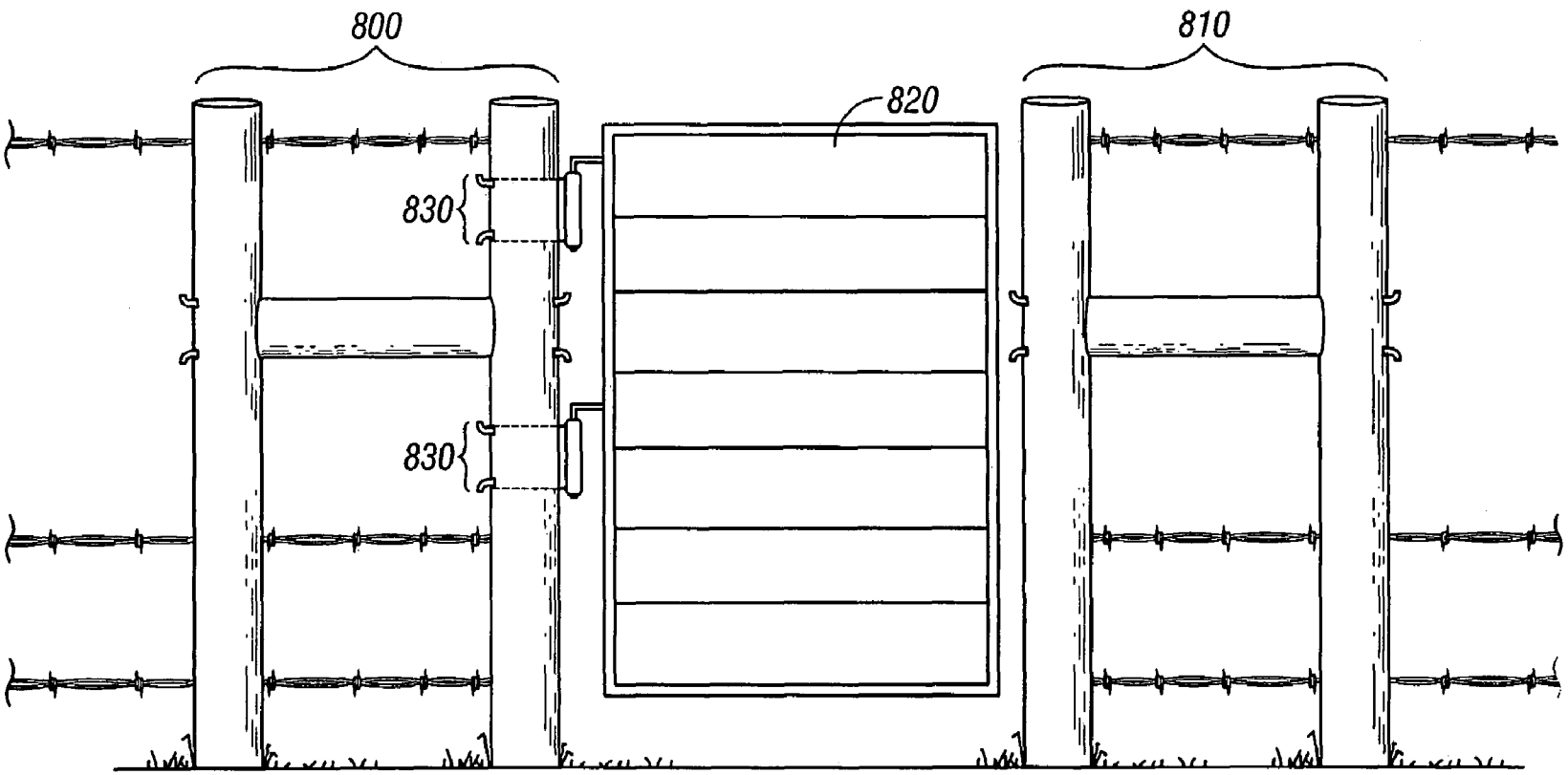
FIG. 8 is a side elevation of a fence with a gate, in accordance with the present invention.

FIG. 8 is a side elevation of a fence with a gate, in accordance with the present invention. In the embodiment shown in FIG. 8, two H-posts 800 and 810 constructed according to the present invention (as explained with respect to FIG. 5) and 800 supports a gate 820 using one or more cross members. H-post 800 ends a line of fence, and H-post 810 ends a line of fence. H-post 810 provides a secure and stable end point for the fence. H-post 800 provides a stable, secure, and level support for a gate 820. The gate 820 can be hinged to the H-post 800 according to commonly used methods, as are known by those skilled in the art, or by hinges 830 attached to the H-post 800 according to the fastening system described herein.

Figure 9A:
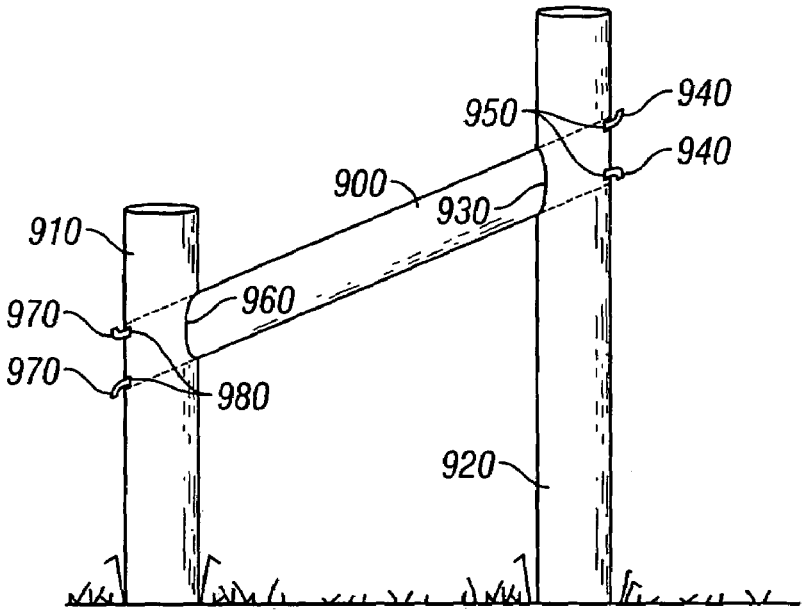
FIG. 9A is a side elevation of a fence brace, constructed according to the present invention.

FIG. 9A is a side elevation of a fence brace, constructed according to the present invention. It is not always desirable for the member 900 to be connected in a manner perpendicular to the posts. As shown in the embodiment illustrated in FIG. 9A, the member 900 may be coupled to the posts 910 and 920 at a specific angle, as needed for the application. As described above, the member 900 passes through an opening 930 in post 920, and the tabs 940 pass through tab slots 950. The tabs 940 are deformed or pinned in place in the tab slots 950 to couple the member 900 to the post 920. In this embodiment, the tab slots 950 are located offset from the opening 930, in order to allow the member 900 to enter the opening 930 at an angle and lock to the post 920 through the tab-slots 950 at an angle. In this embodiment, further stability results from a gripping action created by friction between the member 900 and the edge of the opening 930 in the post 920.

Similarly, the member 900 passes through an opening 960 in post 910, and the tabs 970 pass through tab slots 980. The tabs 970 are deformed or pinned in place in the tab slots 980 to couple the member 900 to the post 910. In this embodiment, the tab slots 980 are located offset from the opening 960, in order to allow the member 900 to enter the opening 960 at an angle and lock to the post 910 through the tab slots 980 at an angle. In this embodiment, further stability results from a gripping action created by friction between the member 900 and the edge of the opening 960 in the post 910.

Figure 9B:
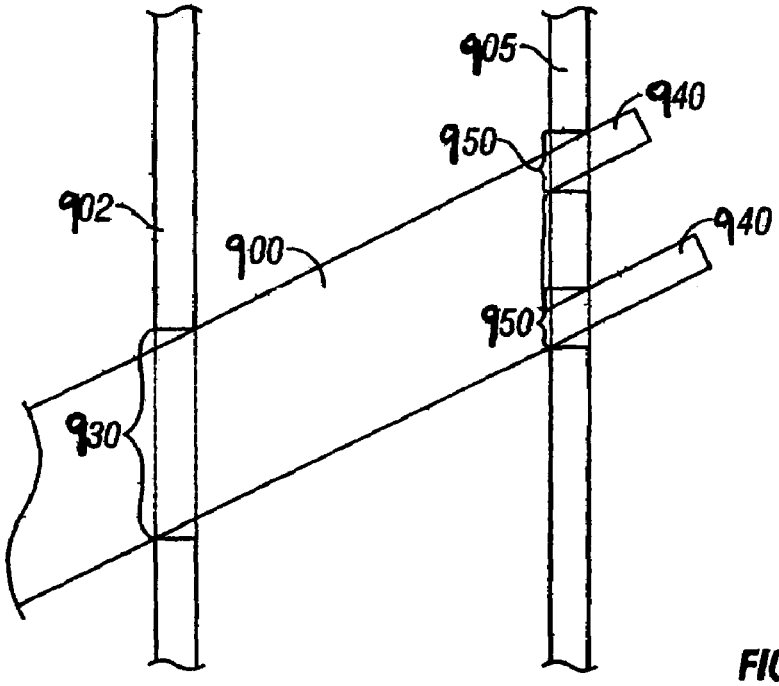
FIG. 9B is an illustrative view of one embodiment of the present invention, showing the friction or gripping action resulting when the member 900 is inserted at a non-90° angle, resulting in limited gripping action.

FIG. 9B is an illustrative view of one embodiment of the present invention, showing the friction or gripping action resulting when the member 900 is inserted at a non-90° angle. The member 900 passes through an opening 930 in the stabilizing surface 902. The tabs 940 on the member 900 pass through the tab-slots 950 in the securing surface 905. In the embodiment shown in FIG. 9B, the depth of the surfaces of the opening 930 and the tab-slots 950 are at a 90° angle through the stabilizing surface 902 and the securing surface 905 respectively. In the embodiment shown in FIG. 9A, the contact, and hence, for example the friction resulting from external forces, is limited to contact between the edge of the surface of the opening 930 in the stabilizing surface 902, and the member 900, rather than with the full depth of the surface of the opening. Additionally, the contact and friction between the surface of the tab-slots 950 in the securing surface 905 and the member 900 is similarly limited.

In the embodiment shown in FIG. 9B, the depth of the sides or edges of the opening 930 and the tab-slots 950 are at a 90° angle through the stabilizing surface 902 and the securing surface 905 respectively. In the embodiment shown in FIG. 9B, the contact, and hence, for example the friction resulting from external forces, is limited to contact between the edge of the depth of the opening 930 in the stabilizing surface 902, and the member 900, rather than with the full depth of the opening. Additionally, the contact and friction between the edge of the tab-slots 950 in the securing surface 905 and the member 900 is similarly limited.

In one embodiment, the tab end of the member may be cut such that it fits flush against the inner surface of the stabilizing surface when the tabs are engaged with the tab-slots. For example, if the stabilizing surface is on a hollow post, the tab end of the member could be cut such that it fits flush against the internal diameter of the stabilizing surface when the tabs are engaged in the tab-slots. For example, where the member is at a non-90° angle relative to the securing surface, the tab end of the member is shaped such that it forms a flush connection with the inner surface of the securing surface with the tabs are engaged in the tab-slots. For example, FIG. 9B, shows an example wherein the tab end of member 900 fits flush against the inner surface of securing surface 905 when the tabs are engaged in the tab-slots. In an optional embodiment, the flush fitting of the tab end of the member with the inner surface (e.g., inner diameter) of the stabilizing surface may be sealed, for example, with a silicon sealer or similar sealing means.

Figure 9C:
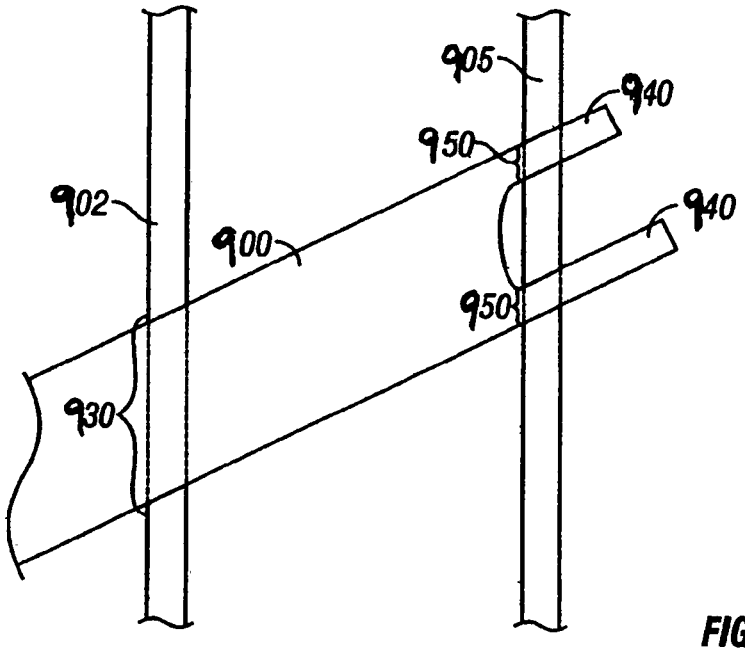
FIG. 9C is an illustrative view of one embodiment of the present invention, showing the friction or gripping action resulting when the member 900 is inserted at a non-90° angle, maximizing the friction or gripping action, and/or weight bearing capabilities.

FIG. 9C is an illustrative view of one embodiment of the present invention, showing contact and the friction or gripping action resulting when the member 900 is inserted at a non-90° angle, but the contact is maximized, thus the friction or gripping action is maximized. The member 900 passes through an opening 930 in the stabilizing surface 902. The tabs 940 on the member 900 pass through the tab-slots 950 in the securing surface 905. In the embodiment shown in FIG. 9C, the opening 930 is cut at an angle through the stabilizing surface 902 such that the angle of the depth of the surface of the opening 930 generally corresponds to the angle of insertion of the member 900, and thus the member 900 makes full contact along the surface of the opening 930 in the stabilizing surface 902. In the embodiment shown in FIG. 9C, the tab-slots 950 are also cut at an angle through the securing surface 905 such that the angle of the surface of the tab-slots 950 generally corresponds to the angle of insertion of the tabs 940, and the tabs 940 make full contact along the surface of the tab-slots 950 in the securing surface 905. The maximized contact between the member and the surface of the opening and the maximized contact between the tabs and the surface of the tab-slots maximizes the strength of the joint and the friction and resulting gripping action created by external forces.

Figure 9D:
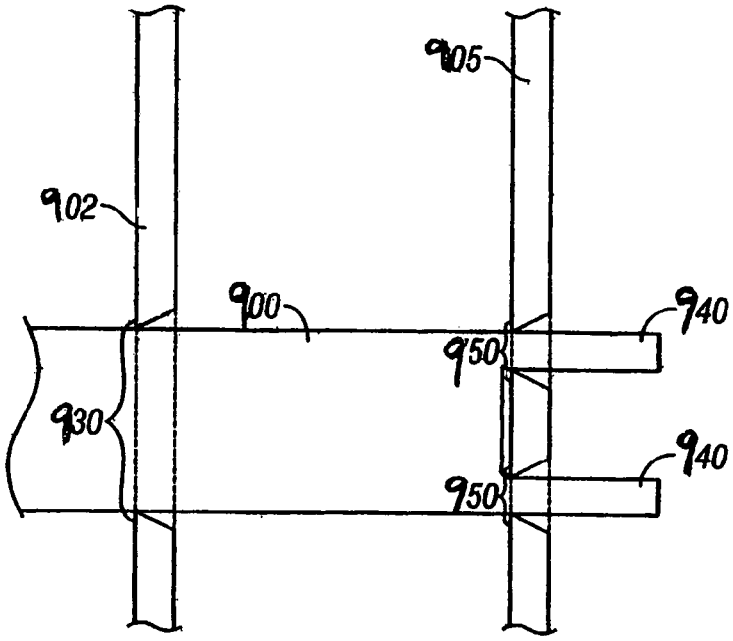
FIG. 9D is an illustrative view of one embodiment of the present invention, showing the limited friction or gripping action resulting when the member 900 is inserted at a 90° angle.

FIG. 9D is an illustrative view of one embodiment of the present invention, showing the contact and friction or gripping action resulting when the member 900 is inserted at a 90° angle. The member 900 passes through an opening 930 in the stabilizing surface 902, where the edge of the depth of the opening 930 is at a non-90° angle, such as may be created by punching to manufacture the opening. The tabs 940 on the member 900 pass through the tab-slots 950 in the securing surface 905, where the edge of the tab-slots 950 are at a non-90° angle. In the embodiment shown in FIG. 9D, the contact and hence the support and friction resulting from external forces is limited in that contact between the edge of the surface of the opening 930 in the stabilizing surface 902 and the member 900. Additionally, the same applies for contact between the edge of the surface of the tab-slots 950 in the securing surface 905 and the member 900.

Figure 9E:
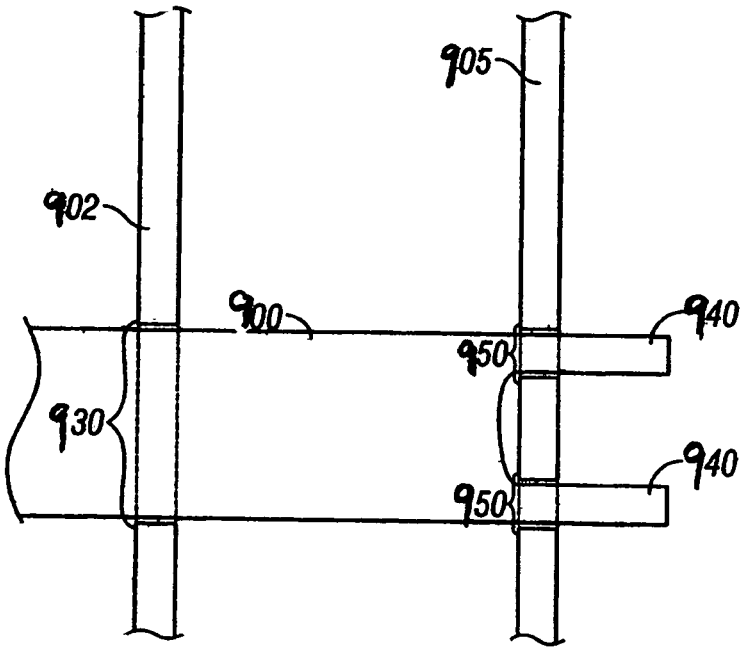
FIG. 9E is an illustrative view of one embodiment of the present invention, showing the maximized friction or gripping action resulting when the member 900 is inserted at a 90° angle.

FIG. 9E is an illustrative view of one embodiment of the present invention, showing the contact, support and the friction or gripping action resulting when the member 900 is inserted at a 90° angle, and the member 900 passes through an opening 930 in the stabilizing surface 902, where the depth edge of the opening 930 is at a 90° angle. In the embodiment shown in FIG. 9E, contact between the surface of the opening 930 in the stabilizing surface 902 and the member 900 is maximized or in full contact. In the embodiment shown in FIG. 9E, the tab-slots 950 are also cut at a 90° angle through the securing surface 905 such that full contact with the surface of the tab-slot is similarly possible.

Figure 10A:
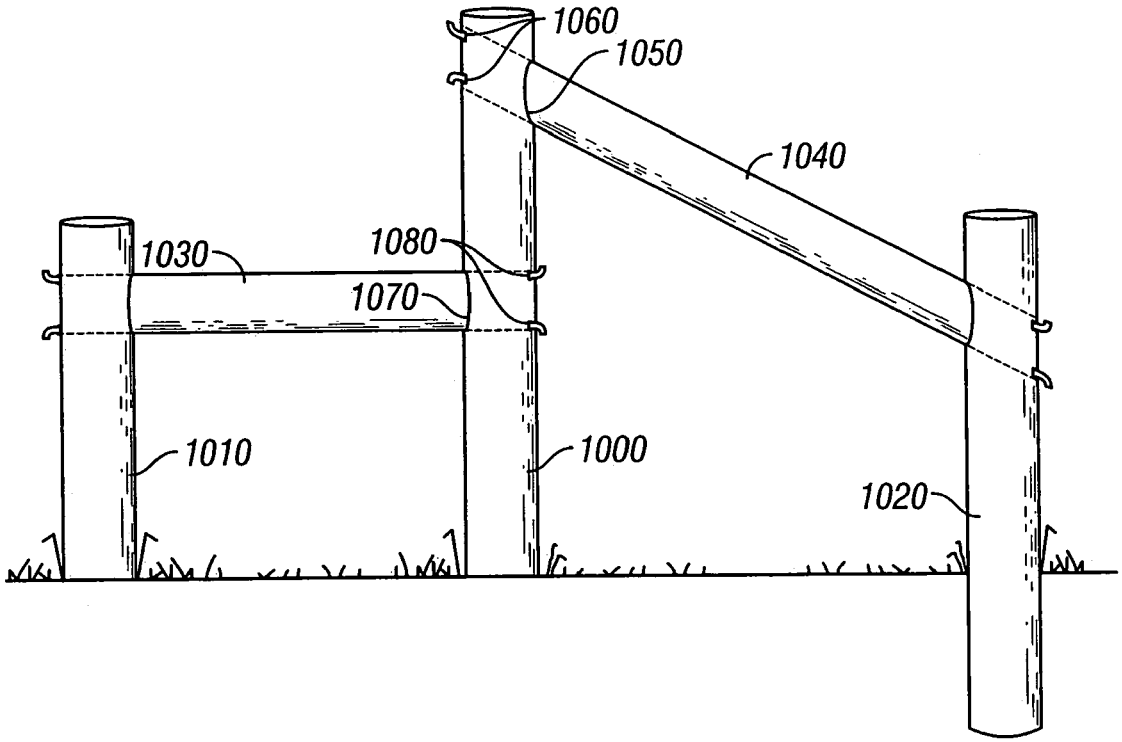
FIG. 10A is a perspective view of an alternative fence brace corner according to the present invention.

FIG. 10A is a perspective view of an alternative fence brace corner according to the present invention. A fence brace corner assembly, shaped like an "L," may be accomplished by construction of two H-posts that share at least one post. A corner post 1000 is connected to a first side post 1010 and a second side post 1020. The corner post 1000 is connected to the first side post 1010 by a first member 1030 and is connected to the second side post 1020 by a second member 1040. The opening 1050 and tab-slots 1060 on the post 1000 where the member 1040 connects are offset from the opening 1070 and tab-slots 1080 on the post 1000 where the member 1030 connects. The result is that the member 1040 will be slightly higher or lower than the member 1030, but the resulting corner structure is secure, stable and capable of bearing a significant weight.

Figure 10B:
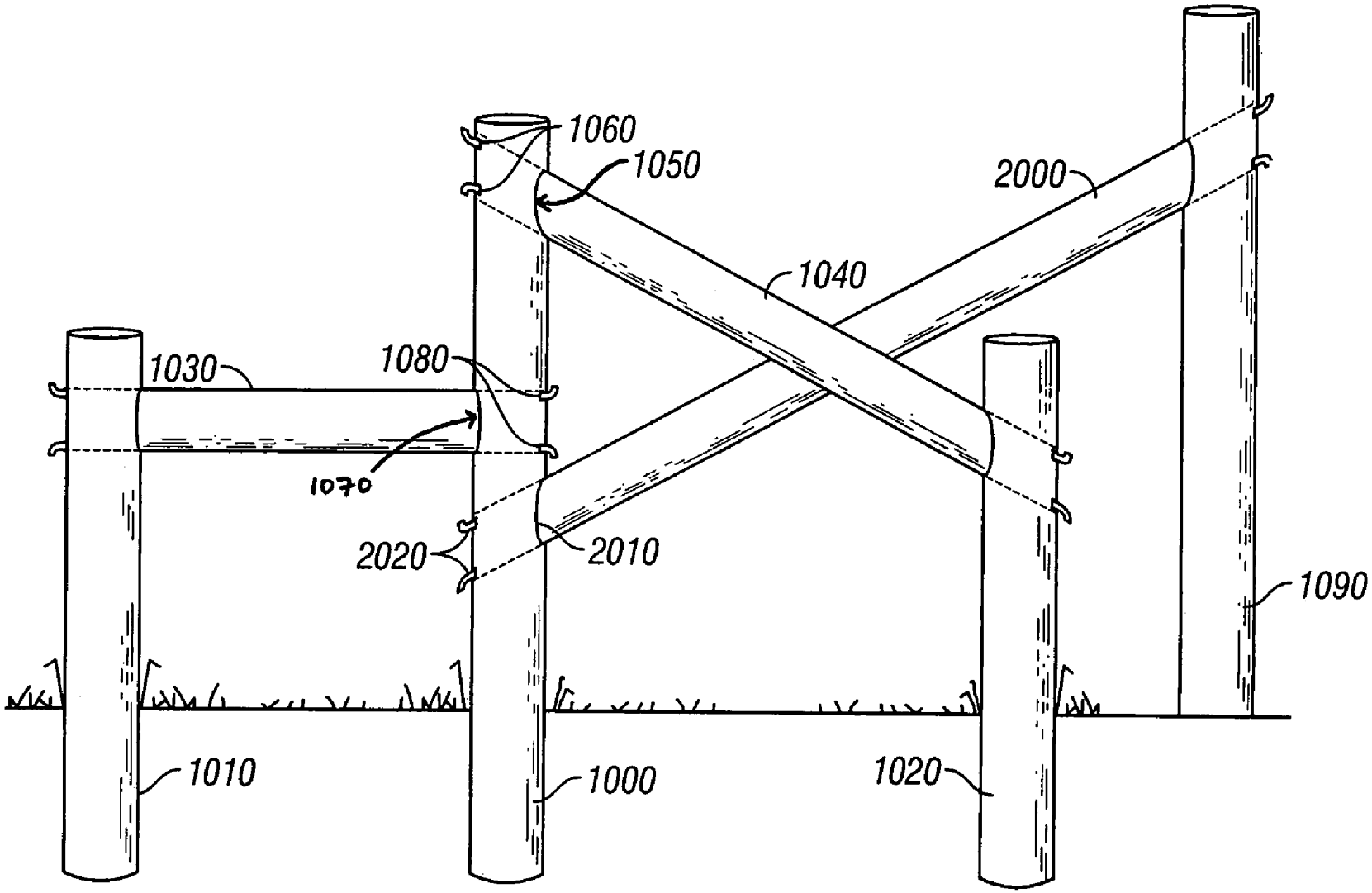
FIG. 10B is a perspective view of yet another alternative fence brace corner according to the present invention.

FIG. 10B is a perspective view of yet another alternative fence brace corner according to the present invention. A fence brace corner assembly, shaped like a "T", or a "Y" for different angles, may be accomplished by construction of three H-posts that share at least one post. The embodiment shown in FIG. 10B may be used where a connection between fences is needed, and the fence continues on in multiple directions, such as, for example, when it is desired that a portion of a field be portioned off from another, or direction change in property lines. The embodiment shown in FIG. 10B may also be useful for construction of structures in various applications, including the construction of scaffolding and the like. A corner post 1000 is connected to a first side post 1010 by a member 1030, a second side post 1020 by a member 1040, and a third side post 1090 by a member 2000. The corner post 1000 includes at least an opening 1050 for receiving member 1040, an opening 1070 for receiving member 1030, and an opening 2010 for receiving member 2000. The corner post 1000 also includes at least tab-slots 1060, tab-slots 1080, and tab slots 2020 for locking to each member. The opening 1050 and tab slots 1060, the opening 1070 and the tab slots 1080, and the opening 2010 and tab-slots 2020 are spaced apart and offset from each other, resulting in the members 1030, 1040, and 2000 being slightly lower or higher than each other, but the resulting corner structure is secure, stable and capable of bearing a significant weight.

Figure 10C:
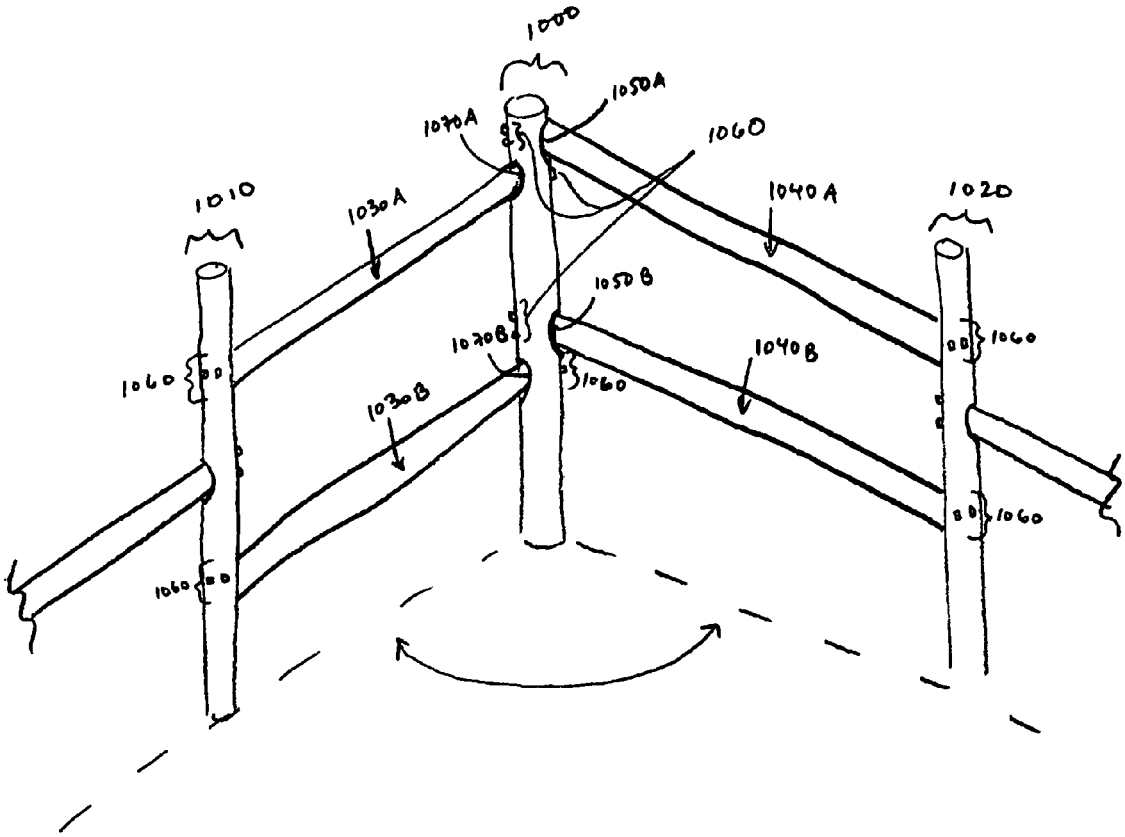
FIG. 10C is a perspective view of yet another alternative fence brace corner according to the present invention.

FIG. 10C is a perspective view of yet another alternative fence brace corner according to the present invention. Post 1000 is joined to post 1010 by members 1030A and 1030B, creating one H-post fence brace in accordance with the present invention and utilizing the joint connection of the present invention. Post 1000 is joined to post 1020 by members 1040A and 1040B, creating one H-post fence brace in accordance with the present invention and utilizing the joint connection of the present invention. The angle between the H-post fence brace created by post 1010 being joined to post 1000 and the H-post fence brace created by post 1000 being joined to post 1020, as shown in FIG. 10C, may vary depending on the application. It should also be recognized that any number of H-post fence braces may be combined, similar to the example embodiment shown in FIG. 10C, as needed.

Figure 11:
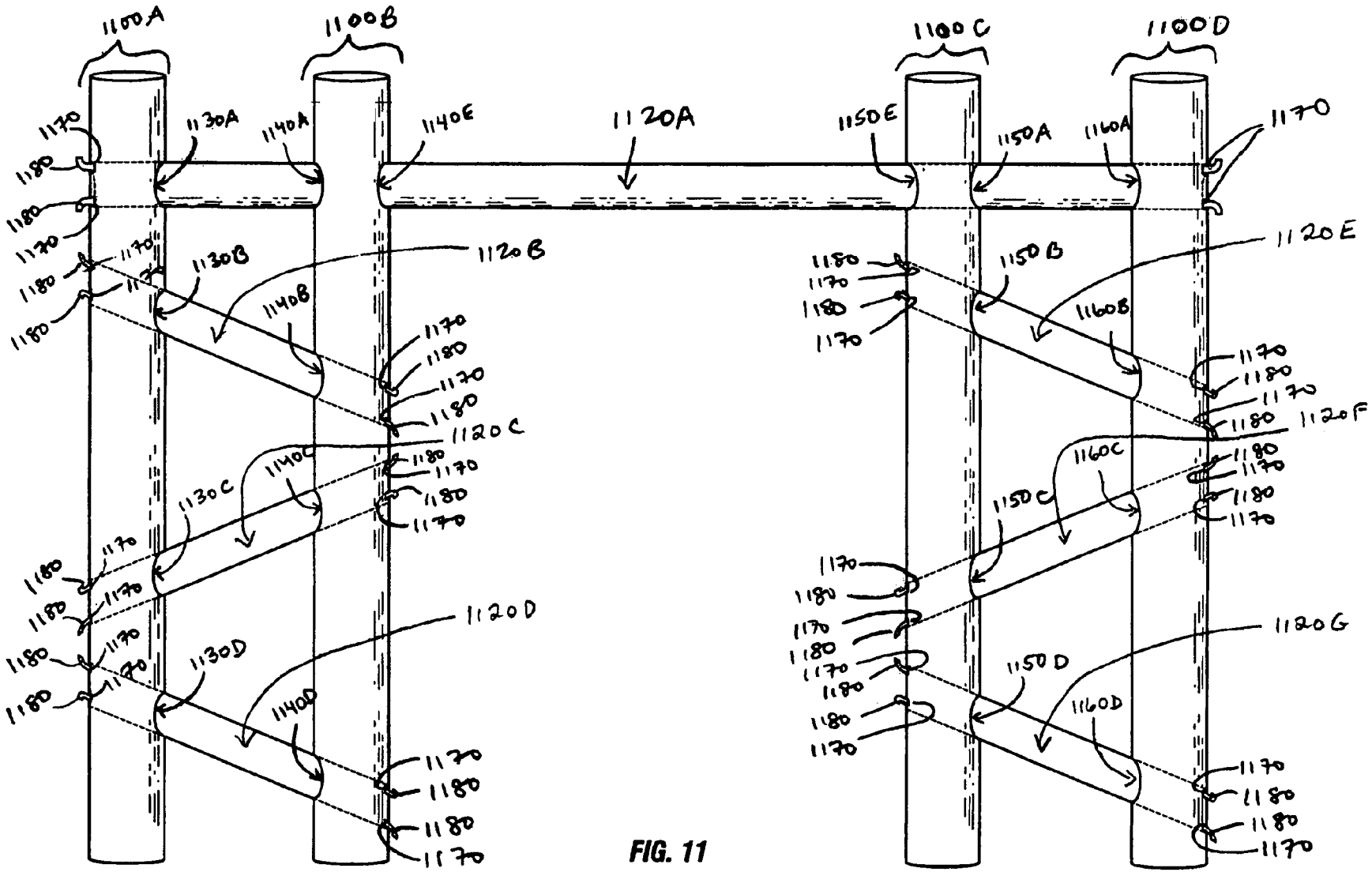
FIG. 11 an illustrative view of one embodiment of the present invention showing that the joint connection of the present invention may be used numerous times to attach each connection necessary in a structure.

FIG. 11 an illustrative view of one embodiment of the present invention showing that the joint connection of the present invention may be used numerous times to attach each connection necessary in a structure. An entire structure may be connected using the joint connection at each necessary connection, for applications such as, for example, support beams for roofing, support beams of airplane wings, tent-like structures, temporary buildings and hunting units such as deer stands and deer blinds, outdoor venue applications. A structure constructed using one or more joint connection of the present invention may similarly be used in applications such as, for example, highway signage structures, supports for advertising signage, and any arch, beam or support structure. As an example, as shown in the embodiment in FIG. 11, a structure may be built with multiple posts 1100A, 1100B, 1110A, and 1100D, and in other embodiments may be built with as many posts as necessary. A member 1120A may, as shown in FIG. 11, connect the multiple posts 1100A-D together. 1120A is inserted through an opening 1130A in post 1100A, through openings 1140A and 1140E in post 1100B, through openings 1150A and 1150E in post 1100C, and opening 1160A in post 1100D. In the embodiment shown in FIG. 11, each post 1100A-1100D has a number of openings. Post 1100A has openings 1130A-D, Post 1100B has openings 1140A-E, Post 1100C has openings 1150A-E, and Post 1100D has openings 1160A-D. Multiple members may then connect between the various posts as needed in the particular embodiment. In the embodiment shown in FIG. 11, members 1120B, 1120C, and 1120D connect posts 1100A and 1100B and additional members 1120E, 1120F, and 1120G connect posts 1100C and 1100D. Accordingly, member 1120B is inserted through opening 1130B in post 1100A and through opening 1140B in post 1100B; member 1120C is inserted through opening 1130C in post 1100A and opening 1140C in post 1100B; member 1120D is inserted through opening 1130D in post 1100A and opening 1140D in post 1100B. Accordingly, member 1120E is inserted through opening 1150B in post 1100C and opening 1160B in post 1100D; member 1120F is inserted through opening 1150C in post 1100C and opening 1160C in post 1100D; and member 1120G is inserted through opening 1150D in post 1100C and opening 1160D in post 1100D. This embodiment demonstrates one example of the many uses of multiple joint connections of the present invention in a multi-component structures.

The following examples are put forth so as to provide those of ordinary skill in the art with a complete disclosure and description of how the invention claimed herein is made and applied in a very broad range of useful applications, and are intended to be purely exemplary of the invention and are not intended to limit the scope of what the inventors regard as their invention.

EXAMPLE 1

A fence with at least one fence brace assembly may be built in accordance with the present invention. As shown in FIG. 5, the various segments and members are not drawn to scale. A fence brace 500 is shown, including upright metal posts 510A and 510B. Posts 510A and 510B have openings 540A and 540B respectively, and tab-slots 550A and 550B. A member 520 has tabs 530 for fastening member 520 to posts 510A and 510B. In one method of installing the fence brace 500, member 520 is inserted into openings 540A and 540B, and tabs 530 are aligned with tab slots 550A and 550B. Tabs 530 are inserted into tab-slots 550A and 550B. In one method of installing the fence brace 500, the tabs 530 are deformed to lock the member 520 to the posts 510A and 510B. In an alternative method of installing the fence brace 500, the tabs 530 are pinned to lock the member 520 to the posts 510A and 510B. In yet another alternative method of installing the fence brace 500, the tabs 530 are glued in place in the tab slots 550A and 550B to lock the member 520 to the posts 510A and 510B. When the member 520 is locked to the posts 510A and 510B, the resulting structure is a rigid H-shaped structure, and the posts 510A and 510B are sunk into holes in the ground and firmly cemented into place with cement 560, or the like. For use as a fence brace assembly, as in the example, the ends of the posts 510A and 510B, with the member 520 installed and secure, may be set in the ground, typically in dirt, concrete or cement, and then leveled. Once set, each post may serve as an anchor or secure location to which barbed wire fencing, gates, and the like may be attached. A fence is then completed by stringing barbed wire 570 from the fence brace down the line to the next adjacent, similar fence brace. Alternatively, posts 510A and 510B may be placed in the post holes before they are back-filled or cemented, and prior to installing member 520 or to leveling and aligning with the fence wire. In such an embodiment, the location of posts 510A and 510B in the post holes may aid in the assembly of the structure, for example, by keeping the posts relatively vertical and aligned during assembly. Once assembled, the posts 510A and 510B may be cemented or back-filled into place.

The assembly of the fence brace 500 is completed without requiring welding, and may even be completed by a single person without significant difficulty. For example, fence wire may be wound around either post at the end of a line of wire. For example, with multiple fence brace assembles spaced along the length of a fence, a fence may have structural stability and the ability to bear the tension load of the wire the length of the fence. The fence may, for example, include a fence brace assembly (with a joint connection of the present invention) located at a corner in a fence to provide a secure anchor. The fence may also, for example, include a fence brace assembly (with a joint connection of the present invention) may additionally, for example, serve as the support for a gate, swinging or otherwise.

Referring to FIG. 5, a fence with at least one fence brace assembly may, for example, be used in applications such as animal pens, all types of gates, and in a similar fashion, in applications such as, for example, architectural railing, stair rails, catwalks, safety railing, commercial fishing applications, and scaffolding. Referring to FIG. 11, it can be seen how a structure may be built with the joint connection of the fence brace assembly, without requiring welding. The resulting structure may be sturdy and stable without requiring welding or additional fasteners.

EXAMPLE 2

In one example of a structure containing the joint connection of the present invention, an H-post fence brace structure contains the joint connection of the present invention. Referring to FIG. 3B, it will be seen that the joint connection of the present invention may be used in, for example, assembling an H-post fence brace. As shown in FIG. 3B, the various segments and members are not drawn to scale. The first post segment 300 and the second post segment 310 may be coupled together by member 320 to form an H-shaped construction. The member 320 is inserted into an opening 330 on the first post segment 300 and an opening 340 on the second post segment 310. In the example, the member 320 may pass through the openings 330 and 340 in the first post segment 300 and the second post segment 310 respectively. On the opposite side of the first post segment 300 to the opening 330 are tab-slots 350. Tabs 370 on the end of member 320 are inserted into the tab-slots 350. On the opposite side of the second post segment 310 opposite to the opening 340 are tab-slots 360. Tabs 380 on the end of member 320 are inserted into the tab-slots 360. After the tabs 370 and 380 on each end of the member 320 are aligned and inserted into the tab-slots 350 and 360, the tabs 370 and 380 are deformed by bending or crimping. Optionally, the connection between the member 320 and each post 300 and 310 may be welded, but welding is not necessary with the joint connection of the present invention. With the tabs 370 and 380 bent or crimped, the member 320 is coupled to both the post segments 300 and 310. For use as a fence brace assembly, as in the example, the ends of the posts 300 and 310, with the member 320 installed and secure, may be set in the ground, typically in dirt, concrete or cement, and then leveled. Alternatively, posts 300 and 310 may be placed in the post holes before they are back-filled or cemented, and prior to installing member 320 or to leveling and aligning. In such an embodiment, the location of posts 300 and 310 in the post holes may aid in the assembly of the structure, for example, by keeping the posts relatively vertical and aligned during assembly. Once assembled, the posts 300 and 310 may be cemented or back-filled into place.

Once set, each post may serve as an anchor or secure location to which barbed wire fencing, gates, and the like may be attached. For example, fence wire may be wound around either post at the end of a line of wire. The constructed fence brace assembly, including the joint connection of the present invention, may be, for example, repeated and spaced along the length of a fence to provide stability and bear the tension load of the length of fence. The constructed fence brace assembly, including the joint connection of the present invention, may be, for example, be located at a corner in a fence to provide a secure anchor. The constructed fence brace assembly, including the joint connection of the present invention, may additionally, for example, serve as the support for a gate, swinging or otherwise.

EXAMPLE 3

The present invention may alternatively be applied for a brace assembly kit for simple, on-location assembly may be built and sold, assembled, partially assembled, or unassembled in accordance with the present invention. Because the joint connection of the present invention does not require welding, a kit that includes the necessary pieces may be sold in a manner that will allow the customer to transport the kit to the location to assemble it. The kit may be assembled without requiring a welder or skilled person, and when assembled, provides a sturdy, load-bearing structure with stable connections.

EXAMPLE 4

The present invention may alternatively be used in connecting materials for structural strengthening designs such as support beams for roofing, support beams of airplane wings, tent-like structures, temporary buildings and hunting units such as deer stands and deer blinds, outdoor venue applications such as, for example, staging for outdoor performances, antennas, highway signage structures and signage connections.

EXAMPLE 5

The present invention may alternatively be used in architectural railing, fencing, stair rails, catwalks, and safety railing. The present invention could be used, for example, in alternating treat stairs and the like, such as, for example, those described in U.S. Pat. No. 4,509,617, which is hereby incorporated by reference in its entirety.

EXAMPLE 6

The present invention may alternatively be used in making joint connections in all different types of structures or storage devices, including, but not limited to, ladders, space station or space craft applications, agricultural grain storage and handling, water towers, petro-chemical storage tanks, light beacon towers

EXAMPLE 7

The present invention may alternatively be used in helix-type designs. Stable structures with a design similar to the structure of DNA double helix-type designs withstand forces at multiple different angles. The use of the present invention in connecting such structures may enable triple or quadruple helix designs using the same joint connection of the present invention.

EXAMPLE 8

The present invention may alternatively be used in equipment, even as a component of a larger device or structure with moving parts, such as, for example, wildlife feeder structures, cattle handling and milking equipment, animal laboratory equipment, construction equipment and machinery, conveyor framework of all types, sand, gravel, and rock crushing equipment framework, irrigation equipment (for example, center pivots), automotive components, motorcycle, bicycle, tricycle, and unicycle components.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine manufacture, composition of matter, means, methods and steps described in the specification and explained in the examples. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. In a fence brace assembly having:

at least one substantially hollow post, comprising a stabilizing surface and a securing surface, said stabilizing surface and said securing surface being substantially opposite each other and having an inner surface and an outer surface;

at least one member, comprising at least one tab;

wherein said stabilizing surface comprises at least one opening, and said securing surface comprises at least one tab-slot;

wherein said member passes through said opening in the stabilizing surface;

wherein said tab enters said tab slots in said securing surface;

wherein the improvement comprises:

said tab having a notch;

said tab-slot shaped to engage said tab when said member is rotated to engage the tab with the tab-slot; and said member having a tab end consisting of at least one tab and a recessed non-tab surface;

said recessed non-tab surface shaped such that its entire surface area fits flush against the internal surface diameter of the stabilizing surface when the tab is engaged via rotation of the member to engage the tab with the tab-slot via the notch.

2. The fence brace assembly of claim 1, having at least one opening located directly opposite to at least one tab-slot, so that when the tab is engaged with the tab-slot, the longitudinal axis of the member is oriented at an angle of about 90° relative to said stabilizing surface.

3. The fence brace assembly of claim 1, having at least one opening not directly opposite, but offset from at least one tab-slot, so that the longitudinal axis of the member is oriented at a non-90° angle relative to said stabilizing surface.

4. The fence brace assembly of claim 1, having said post comprised of metal tubing.

5. The fence brace assembly of claim 1, having said member comprised of metal tubing.

6. The fence brace assembly of claim 1, having at least one opening corresponding in shape and size to said member.

7. The fence brace assembly of claim 1, having at least one opening shaped so that said member passes snugly through said opening.

8. The fence brace assembly of claim 1, having the size and shape of said tab-slots corresponding to said tabs.

9. In the fence brace assembly of claim 1, wherein the improvement further comprises that said at least one opening is produced by the process of being cut by a laser.

10. The fence brace assembly of claim 1, wherein the sealer is a silicone sealer.

11. In a method for assembling a fence brace assembly, having the steps of:

providing at least one substantially hollow post, comprising a stabilizing surface and a securing surface, said stabilizing surface and said securing surface being substantially opposite each other and having an inner surface and an outer surface;

providing at least one member, comprising at least one tab end, said tab end having at least one tab and a recessed non-tab surface;

wherein said stabilizing surface comprises at least one opening, and said securing surface comprises at least one tab-slot;

passing said member through said opening;

wherein the improvement comprises:

providing a notch in said tab;

providing a tab-slot being shaped to engage said notched tab when said member is rotated to engage the tab with the tab-slot;

providing a shaped non-tab surface of the member, shaped such that its entire surface area fits flush against the internal surface diameter of the stabilizing surface when said tab is engaged via rotation of the member to engage the tab with the tab-slot via the notch;

passing said at least one notched tab into said tab-slot; and rotating said member to:

i) engage said notched tab with said tab-slot; and ii) to position the recessed non-tab surface of said member such that its entire surface area fits flush against the internal surface diameter of the stabilizing surface.

12. The method for assembling a fence brace assembly of claim 11, having at least one opening located directly opposite to at least one tab-slot, so that when the tab is engaged with the tab-slot, the longitudinal axis of the member is oriented at an angle of about 90° relative to said stabilizing surface.

13. The method for assembling a fence brace assembly of claim 11, having at least one opening is not directly opposite said tab slots, but offset from at least one tab-slot, so that when the tab is engaged with the tab-slot, the longitudinal axis of the member is oriented at a non-90° angle relative to said stabilizing surface.

14. In the method for assembling a fence brace assembly of claim 11, wherein the improvement further comprises the additional step of sealing the area of contact between the non-tab surface area of the member and the inner surface of the securing surface.

15. In the method for assembling a fence brace assembly of claim 14, wherein the improvement further comprises said sealing using a silicone sealer.

16. A kit for assembling a fence brace assembly having component parts capable of being assembled, the kit comprising:

at least one post, capable of being joined to at least one member;

at least one member, capable of being joined to the post;

said post comprising:

i) a stabilizing surface and a securing surface, said stabilizing surface and said securing surface being substantially opposite each other and having an inner surface and an outer surface;

ii) at least one tab-slot in said securing surface, said tab-slot capable of accepting and engaging a notched tab by the via rotation of the tab;

iii) at least one opening in said securing surface, said opening capable of accepting said at least one member;

said member comprising:

iii) at least one tab end consisting of at least one tab and a recessed non-tab surface, iv) at least one tab being notched and thereby being capable of engaging with the tab-slot when said member is rotated;

v) said recessed non-tab surface shaped such that its entire surface area fits flush against the internal surface diameter of the stabilizing surface when said tab is engaged via rotation of the member to engage the tab with the tab-slot; and said member and said post being capable of being joined by inserting said tab end of said member into said opening in said stabilizing surface of said post and rotating said member to engage the notched tab in the tab slot, and therefore being capable of forming a substantially continuous flush contact between the entire non-tab surface area of the tab end of the member and the internal surface diameter of said securing surface when said member is joined to said post such that the entire non-tab surface area of the tab end of the member fits flush against the internal surface diameter of the stabilizing surface.

17. The kit for assembling a fence brace assembly of claim 16, wherein said at least one opening is located directly opposite to at least one tab-slot, so that said member is capable of being rotated into the engaged position with said post, such that when the post and the member are joined, the longitudinal axis of the member is oriented at an angle of about 90° relative to said stabilizing surface.

18. The kit for assembling a fence brace assembly of claim 16, wherein said at least one opening is not directly opposite said tab slots, but is offset from at least one tab-slot, so that said member is capable of being rotated into the engaged position with said post, such that when the post and the member are joined, the longitudinal axis of the member is oriented at a non-90° angle relative to said stabilizing surface.

19. The kit for assembling a fence brace assembly of claim 16, wherein the area of contact between the non-tab surface of the member and the inner surface of the post is capable of being sealed.

* * * * *